US007145532B2

(12) United States Patent
Kageyama et al.

(10) Patent No.: US 7,145,532 B2
(45) Date of Patent: Dec. 5, 2006

(54) IMAGE DISPLAY APPARATUS

(75) Inventors: Hiroshi Kageyama, Hachioji (JP); Hajime Akimoto, Ome (JP)

(73) Assignee: Hitachi, Ltd., Tokyo (JP)

( * ) Notice: Subject to any disclaimer, the term of this patent is extended or adjusted under 35 U.S.C. 154(b) by 347 days.

(21) Appl. No.: 10/438,037

(22) Filed: May 15, 2003

(65) Prior Publication Data

US 2003/0214522 A1 Nov. 20, 2003

(30) Foreign Application Priority Data

May 17, 2002 (JP) ..... P2002-142366

(51) Int. Cl.
*G09G 3/30* (2006.01)

(52) U.S. Cl. ..... 345/77; 345/76

(58) Field of Classification Search ..... 345/76–83, 345/204–206, 691–693
See application file for complete search history.

(56) References Cited

U.S. PATENT DOCUMENTS 6,618,031 B1 * 9/2003 Bohn et al. ..... 345/83
6,873,310 B1 * 3/2005 Matsueda ..... 345/77
2002/0195968 A1 * 12/2002 Sanford et al. ..... 315/169.3

FOREIGN PATENT DOCUMENTS

JP 2000235370 A * 8/2000

* cited by examiner

*Primary Examiner*—Sumati Lefkowitz
*Assistant Examiner*—Ke Xiao
(74) *Attorney, Agent, or Firm*—Antonelli, Terry, Stout and Kraus, LLP.

(57) ABSTRACT

There is provided an image display apparatus having light emitting elements in its pixels, and capable of producing a high-resolution, multi-gray-scale-level display. In an embodiment of the present invention, each of pixel circuits is provided with a current limiting circuit for generating a specified drive current and a time modulation circuit for modulating a duration of time supplying the specified drive current to the light emitting element. In another embodiment of the present invention, each of pixel circuits is provided with a current limiting circuit for generating a specified drive current and a current generator circuit for generating a plurality of values of currents on the basis of the specified drive current.

4 Claims, 13 Drawing Sheets

IMAGE DISPLAY APPARATUS

BACKGROUND OF THE INVENTION

1. Technical Field of the Invention

The present invention relates to an image display apparatus, and particularly to an image display apparatus having a light emitting element in each of its pixels.

2. Prior Art

Among the image display apparatuses employing a light emitting element in each of its pixels, many reports have been made on EL displays using electroluminescent (hereinafter abbreviated as EL) elements.

In the active matrix type EL display, wiring lines for transmitting signals and currents are arranged in a matrix configuration, and a pixel circuit formed of thin film transistors (hereinafter abbreviated as TFTS), which are active elements, is incorporated in addition to the EL element within each of its pixels.

As methods for the pixel circuit to control light intensity of the EL element, there are a method by controlling a voltage supplied to the EL element by the pixel circuit, and another way by controlling a current supplied to the EL element by the pixel circuit.

The method by controlling the current provides the following advantages: (1) The control is facilitated because the light intensity of the EL element varies in proportion to the current; (2) The method is less susceptible to a voltage drop due to power supply lines; and (3) The method is not prone to deterioration of the EL element. A method of controlling light intensity of the EL element by controlling the current is reported in connection with FIGS. 7 and 8 at pages 875–878, IEEE, IEDM 98.

FIG. 14 illustrates a conventional pixel using an EL element. A pixel 150 is composed of a pixel circuit and an EL element 156. The pixel circuit is composed of TFT 151–TFT 154, and a capacitor 155. TFT 151 and TFT 153 are turned ON when an analog current IDADA, which is a display signal, is written into the pixel circuit, thereby the current IDATA flows into the EL element 156 via TFT 151 and TFT 152. The capacitor 155 stores a voltage V between gate and source electrodes of TFT 152 which is required for TFT 152 to flow the current IDATA therethrough. The stored current is reproduced in the EL element 156 by turning ON TFT 154 and thereby supplying the current to TFT 152. At this time, since the voltage V is stored in the capacitor 155, a current flowing through TFT 154, that is, a current flowing through the EL element 156, is controlled by the current IDATA. The light intensity of the EL element 156 is proportional to the current flowing therethrough, and therefore, the light intensity of the EL element can be controlled based upon the analog current IDADA, which is the display signal. Among EL elements varying its light intensity in proportion to a current therethrough, an organic EL diode is known. An image is displayed by writing currents IDATA successively into such pixels arranged in two dimensions.

SUMMARY OF THE INVENTION

Problems to be Solved by the Invention

In a case in which display signals in the form of analog currents are written into pixels as shown in FIG. 14, the display signals are supplied successively into a plurality of pixels via the lines 161. The line 161 has capacitive load 162 formed with components of the display such as intersecting signal lines, adjacent wiring lines, and electrodes of the EL elements. It is inevitable to charge the capacitive load 162 for transmitting a current signal to an intended one of the EL elements from a current drive circuit 157 external to a display region where the pixels are disposed.

Time required for charging the capacitive load 162 is in inverse proportion to a current based upon a relationship C(capacitance)×V(voltage)=I(current)×t(time). Consequently, in a case in which a pixel produces a dark display, time required for charging the capacitive load is increased because a current flowing through the EL element is reduced compared with a case in which the pixel produces a bright display. For example, if time required for charging the capacitive load is 1 μs when the brightest display is produced, then the charging time is 10 μs when one tenth of the brightest display is produced, and the charging time is 100 μs when one hundredth of the brightest display is produced.

On the other hand, time required for transmitting a current signal to an intended one of the EL elements from a drive circuit external to a display region where the pixels are disposed must be one line period at the longest. One line period is equal to time for writing display information into pixels arranged in a horizontal line, and decreases with increasing resolution, as about 60 μs for resolution of QVGA (320 pixels×240 pixels), about 30 μs for resolution of VGA (640 pixels×480 pixels), about 20 μs for resolution of XGA (1024 pixels×768 pixels). It is difficult to display multi-gray scale image, and further, one line period is shortened, and it becomes difficult to configure a high-resolution EL display.

The present invention writes a relatively large current for causing a pixel to produce a bright display into the pixel as a reference current, and produces a plurality of gray scale levels on the basis of the reference current.

Means for Solving the Problems

An image display apparatus in accordance with the present invention is provided with current limiting means for producing a specified drive current in a pixel circuit, and a time modulation circuit for modulating a length of time for supplying a specified drive current to a light emitting element.

Further, in the image display apparatus in accordance with the present invention, the time modulation circuit modulates by using analog voltage signals or digital signals.

Further, an image display apparatus in accordance with the present invention is provided with current limiting means for producing a specified drive current in a pixel circuit, and a current generator circuit for generating currents of different values on the basis of a specified drive current.

Further, in the image display apparatus in accordance with the present invention, the values of currents generated in the current generator circuit are controlled by display signals in the form of analog voltage signals.

Further, in the image display apparatus in accordance with the present invention, the currents generated by the current limiting means are maximum currents flowing through the light emitting element.

Further, the image display apparatus in accordance with the present invention is provided with a reference-current source for generating a reference current serving as a specified drive current outside of the pixel circuit, and its current limiting means generates a current proportional to the reference current generated by the reference-current source.

BRIEF DESCRIPTION OF THE DRAWINGS

DETAILED DESCRIPTION OF THE PREFERRED EMBODIMENTS (1) FIG. 1 is a circuit diagram illustrating pixels and their peripheries in a first embodiment in accordance with the present invention. A plurality of pixels 12 are arranged in two dimensions in a display region 11 for displaying an image. The pixel 12 is composed of a pixel circuit formed of TFT 13–TFT 18 and capacitors 19, 20, and an EL element 21. A cathode of the EL element 21 is connected to a common electrode 29. All of TFT 13–TFT 18 are n-channel type thin film transistors. Arranged in a matrix configuration in the display region 11 are signal lines D1, D2 for transmitting analog voltage signals containing display signals, lines E1, E2 for supplying a current serving as a reference, and a current to be flowed into the EL element 21, and signal lines W1, W2, P1, P2, L1, L2, R1, R2 for controlling the pixel circuit of the pixel 12.

Figure 1:
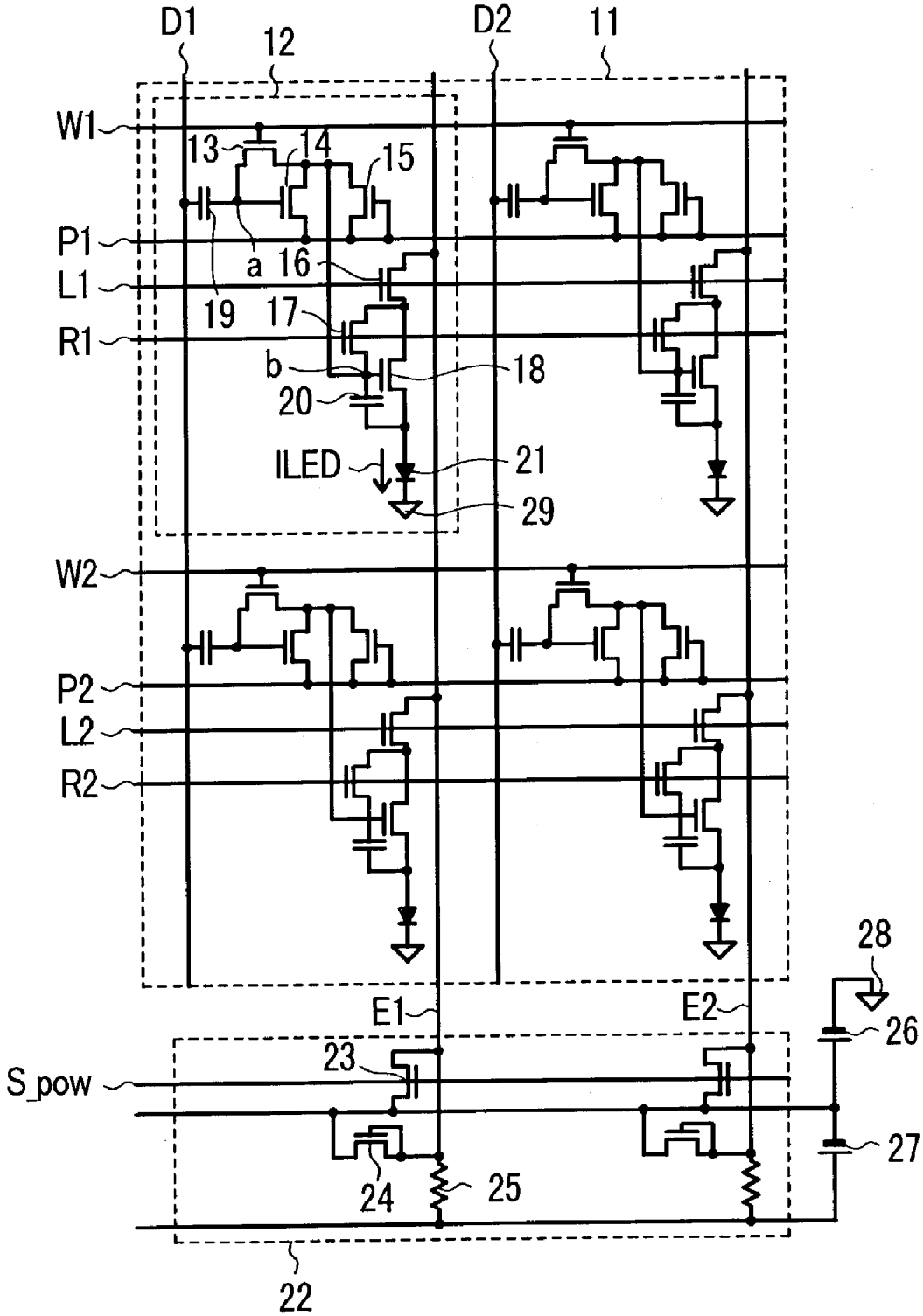
FIG. 1 is a circuit diagram illustrating pixels and their peripheries in a first embodiment in accordance with the present invention.

A reference-current source 22 is disposed outside of the display region 11, and is composed of a plurality of TFT-resistor combinations arranged laterally in FIG. 1. Each of the TFT-resistor combinations is formed of TFT 23, TFT 24, and a resistor 25. The reference-current source 22 is connected to a signal line S_pow carrying a signal for switching between the reference current and a power-supply current, a power supply 26 for supplying a current to the EL element 21, a power supply 27 for generating the reference current, and lines E1, E2. The negative side of the power supply 27 is connected to a grounding electrode 28. The grounding electrode 28 and the common electrode 29 are electrically connected together.

Figure 2:
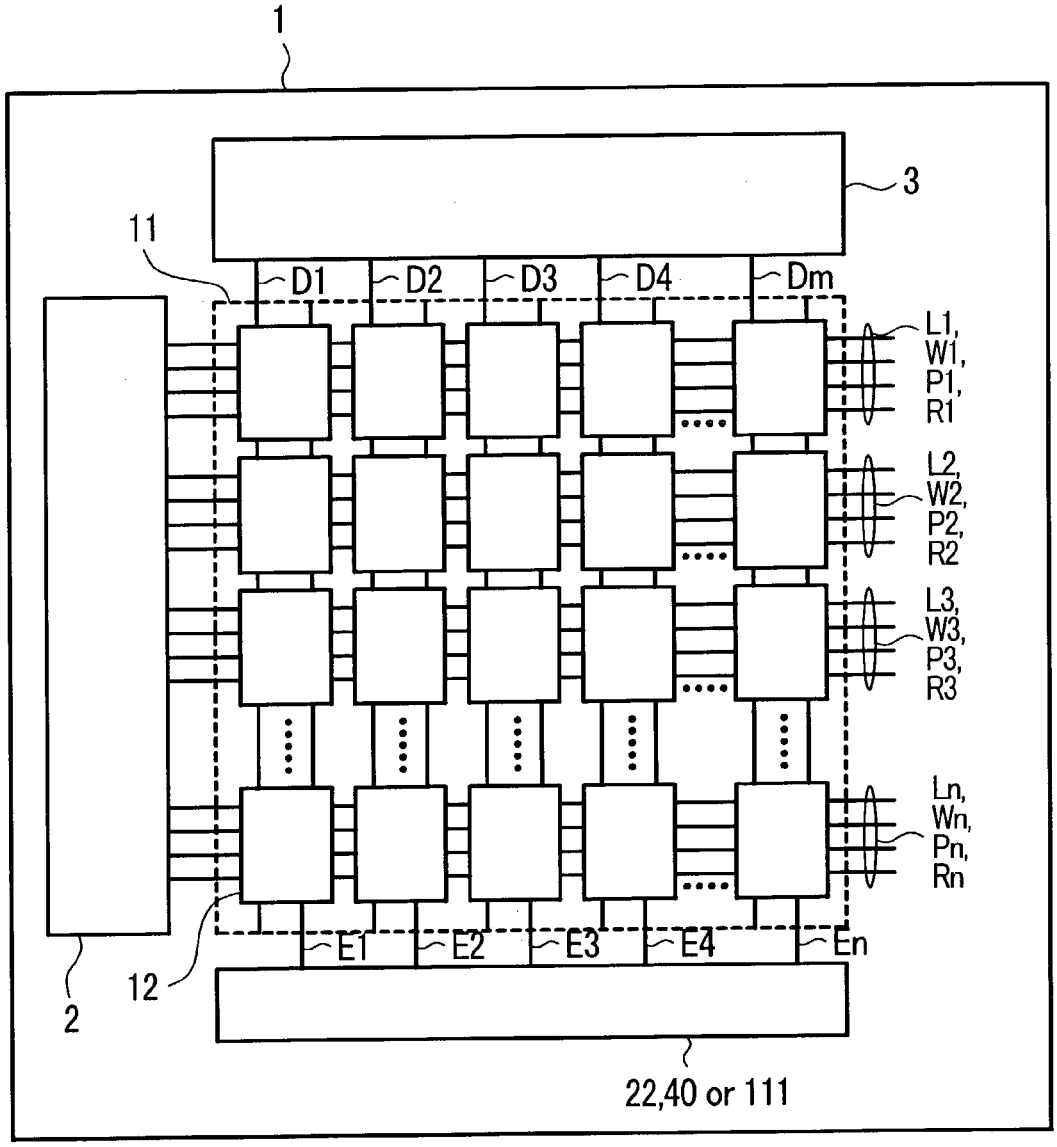
FIG. 2 is an illustration of a configuration of an embodiment in accordance with the present invention.

FIG. 2 is an illustration of a configuration of an embodiment in accordance with the present invention. The display region 11 is disposed on a surface of a glass substrate 1, and a plurality of pixels 12 are fabricated in the display region 11.

With the configuration of the embodiment of the present invention in FIG. 2, in the first embodiment of the present invention, disposed on the surface of the glass substrate 1 are the signal lines L1–Ln, W1–Wn, P1–Pn, and R1–Rn, the signal lines D1–Dm, lines E1–Em, a scanning circuit 2 for generating control signals for the signal lines L1–Ln, W1–Wn, P1–Pn, and R1–Rn, a signal circuit 3 for generating signals for the signal lines D1–DM, and a reference current source 22 for generating currents in the lines E1, E2. The scanning circuit 2, the signal circuit 3, and the reference current source 22 can be formed by fabricating thin film transistors on the glass substrate 1, or can be formed by attaching semiconductor LSIs on the glass substrate 1. Capability of the scanning circuit 2 for supplying signals to the signal lines L1–Ln, W1–Wn, P1–Pn, and R1–Rn is improved by arranging the scanning circuits 2 on opposite sides of the display region 11. The signal circuit 3 and the reference current source 22 may be disposed either above or below the display region 11 in FIG. 2. The scanning circuit 2 is a logical circuit for generating binary digital signals for the signal lines L1–Ln, W1–Wn, P1–Pn, and R1–Rn. The signal circuit 3 is an analog circuit for supplying display signals in the form of analog voltage signals to the signal lines D1–Dm. Although not shown in FIG. 2, the common electrode 29 is formed to cover the display region 11, and is connected to the cathodes of the EL elements 21 of the pixels 12. Light emitted from the EL element 21 of the pixel 12 passes through the glass substrate 1 toward its rear surface, and a display image is viewed from the reverse side of paper of FIG. 2. If the common electrode 29 is made of transparent material, the display image can also be viewed from the front side of FIG. 2. An organic EL diode can be used as the EL element 21. If red, green, and blue light emitting materials are used for corresponding ones of the EL elements 21, a color display can be produced.

Incidentally, the display region 11 is illustrated as formed of only four (2×2) pixels 12 in FIG. 1, but the display region 11 intended for practical use has a larger number of pixels. In the case of resolution of color VGA (640 pixels×3 colors (red, green and blue)×480 pixels), the number m of pixels arranged in a horizontal direction in FIG. 2=1,920, and the number n of pixels arranged in a vertical direction in FIG. 2=480. The numbers of the signal lines D1–Dm and the lines E1–Em are 1,920, respectively. The numbers of the signal lines L1–Ln, W1–Wn, P1–Pn, and R1–Rn are 480, respectively.

Figure 3A:
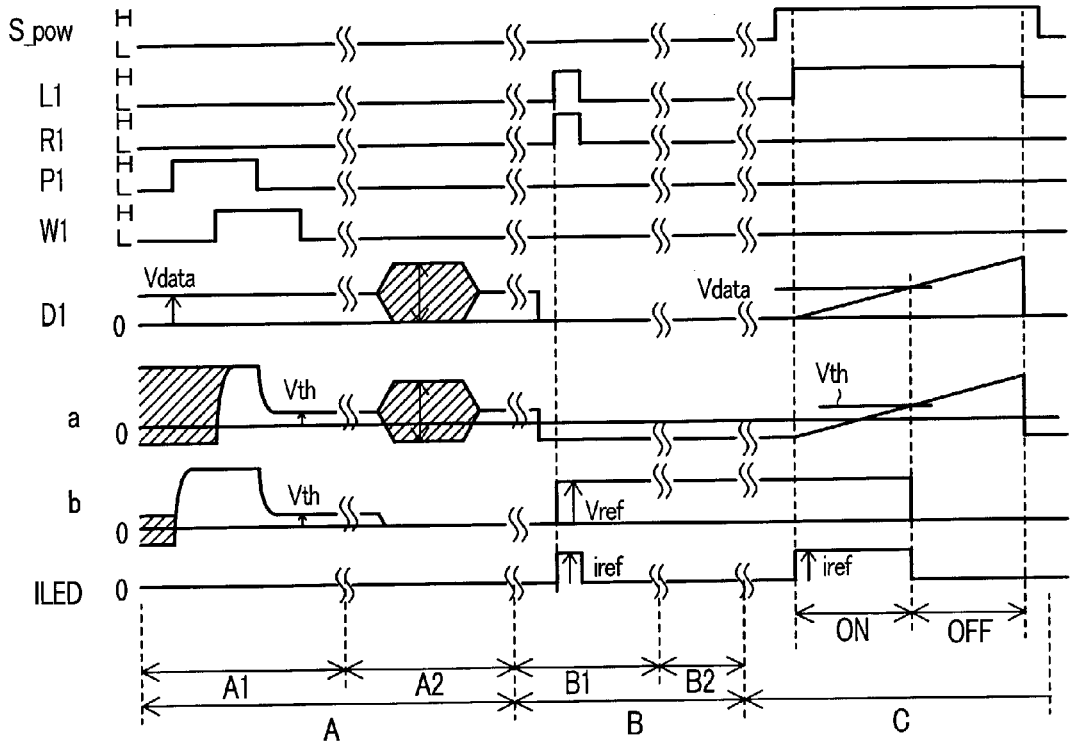
FIG. 3 illustrates a drive voltage waveform, an operating voltage waveform, an operating current waveform, and their timing charts during one frame period, of the pixels in the first embodiment in accordance with the present invention.
Figure 3B:
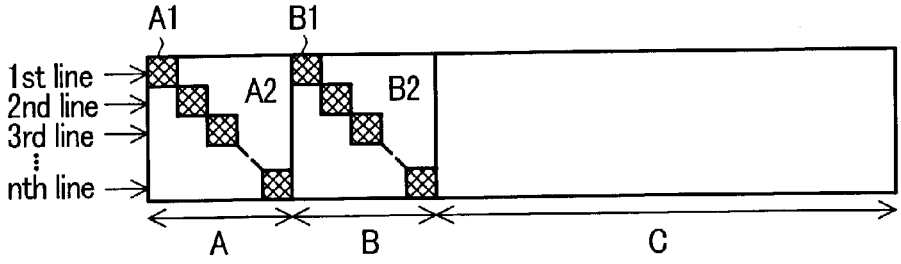

FIG. 3A illustrates a drive voltage waveform, an operating voltage waveform, and an operating current waveform of the pixels in the first embodiment in accordance with the present invention, and FIG. 3B is a timing chart of the waveforms of FIG. 3A during one frame period. The abscissa of FIG. 3A represents time, there is discontinuity in time in portions indicated by wavy lines, and this means that it is possible to change the order of arrangement of times A1, A2, B1, B2 and C. S_pow, L1, R1, P1, W1, and D1 represent voltages supplied to their corresponding lines on corresponding ones of the ordinates. "a" and "b" of FIG. 3A represent voltages appearing at nodes a and b in FIG. 1 on the respective ordinates. ILED indicates a current flowing into the EL element 21 on the ordinate. In FIG. 3A, the more positive values are nearer the top of FIG. 3A. The signals of S_pow, L1, R1, P1, and W1 are binary logical voltages, H and L levels, and the signal of D1 is an analog signal voltage. The H level is a voltage higher than a voltage capable of turning ON any of TFTs in the pixel 12, and the L level is a voltage lower than a voltage capable of turning OFF any of TFTs in the pixel 12. Hatched portions in FIG. 3A indicate they can take plural values, or they are not relevant to operations.

A suffix "1" in L1, R1, P1, W1, and D1 in FIG. 3A indicates that they are signals supplied to the pixel 12 in the first column and the first row, and therefore voltages L, R, P, W and D for other pixels are followed by numerals indicating rows or columns associated with them.

In the timing chart in FIG. 3B, the ordinate represents line numbers in the display region 11, "mth" indicating that a given pixel 12 is in the mth line from the top of the display region 11, and the abscissa represents time in one frame period.

One frame period is divided into a time A for writing display signals into pixels, a time B for writing a reference current into the pixels, and a time C for the EL elements to emit light and thereby to display an image. Further, the time A is divided into times Al each of which is used for writing display signals into pixels in a given line and times A2 each of which is used for writing display signals into pixels in lines other than the given line, and the time B is divided into times B1 each of which is used for writing a reference signal into pixels in a given line and times B2 each of which is used for writing the reference current into pixels in lines other than the given line.

During the time A, the times A1 are assigned to successive time positions of the first (at the beginning of the time A), second, third, . . . , nth lines (at the end of the time A), respectively, and the rest of the time A after the times A1 are the times A2. In the similar way, during the time B, the times B1 are assigned to successive time positions of the first (at the beginning of the time B), second, third, . . . , nth lines (at the end of the time B), respectively, and the rest of the time B after the times B1 are the times B2.

During the time A1, TFT 13–TFT 15 and the capacitor 19 of the pixel circuit operate. When the analog voltage signal Vdata, which is a display signal, is supplied to the signal line D1, the voltage is also supplied to one terminal of the capacitor 19 coupled to the signal line D1. Initially, when the signal line P1 is changed to the H level, the voltage is transferred to the node b via TFT 15. Next, when the signal line W1 is changed to the H level, TFT 13 is turned ON, and the node b also goes to the H level. Thereafter, when the signal line P1 is changed to the L level, a current flows through TFT 14, and there remains at the nodes a and b, a threshold voltage vth which is a voltage between the gate and source electrodes of TFT 14 just enough to switch between ON and OFF states between the drain and source electrodes of TFT 14, and therefore the threshold voltage Vth is applied to the other terminal of the capacitor 19. Finally, the signal line W1 is changed to the L level, the node a is disconnected from the node b, and thereby the capacitor 19 stores the voltage (Vdata-vth).

During the time A2, since display signals are being written into the pixels in the lines other than the given line, the signals on the signal lines L1, R1, P1, and W1 are unchanged. At this time, although the voltage on the signal line D1 changes, TFT 13 is in the OFF state, and therefore the voltage (Vdata-Vth) stored in the capacitor 19 is retained.

During the time B, when the signal line S_pow is maintained at the L level, since TFT 23 of the reference current source 22 is in the OFF state, the line E1 is supplied with a current from the power supply 27 via a resistor 25. The current iref flowing through the line E1 can be obtained which is a constant current nearly equal to Vx/Rx, where Vx is a voltage of the power source 27, and Rx is a resistance of the resistor 25, by selecting the voltage of the power supply 27 to be sufficiently high.

The resistor 25 can be fabricated by patterning into a narrow strip a polysilicon film used for source and drain electrodes of thin film transistors, or a metal lead used for a gate electrode of thin film transistors. In this embodiment, TFT 24 is provided as a protective diode circuit for preventing the high voltage of the power supply 27 from appearing on the lines E1, E2.

During the time B1, TFT 16–TFT 18 and the capacitor 20 of the pixel circuit operate. During the time B1, by changing the signal lines L1 and R1 to the H level, TFT 16 and TFT 17 are turned ON, thereby the constant current iref generated by the reference current source 22 flows through TFT 18. At this time, TFT 18 operates in its saturation region, and there appears between the gate and source electrodes of TFT 18, a voltage Vref necessary for TFT 18 to flow the current iref between its drain and source electrodes, and the voltage Vref is applied to the capacitor 20. Thereafter, when the signal lines L1 and R1 change to the L level, and thereby TFT 16 and TFT 17 are turned OFF, the current flowing through TFT 18 changes to zero, but the voltage Vref is stored in the capacitor 20.

During the time B2, although the current iref is being written into the pixels in the lines other than the given line, since the control signals on the signal lines L1 and R1 are at the L level, TFT 16 and TFT 17 continue to be in the OFF state, and therefore the voltage of the capacitor 20 is retained.

During the time C, the signal line S_pow is changed to the H level, and thereby TFT 23 is turned ON, and the reference current source 22 does not function, the lines E1 and E2 are supplied with a current from the power supply 26, but not from the reference current source 22. By changing the signal line L1 to the H level, TFT 18 is supplied with the current from the power supply 26 via TFT 16. At this time, TFTs 18 in all the pixel circuits generate the constant current iref due to the voltage Vref stored in the capacitor 20, and consequently, the constant current iref flow through the EL elements 21, and the EL elements 21 emit light of uniform intensity (the EL elements are ON).

On the other hand, the signal line D1 is supplied with a triangular waveform voltage varying from the lowest voltage to the highest voltage of a range where analog voltages of display signals can take. During the time C, the voltage on the signal line D1 increases gradually with time in a triangular waveform fashion, and therefore the voltage at the node a in the pixel 12 also increases. When the voltage on the signal line D1 becomes equal to the voltage Vdata having been written into each of the pixels 12 during the time A1, the voltage at the node a becomes equal to the threshold voltage Vth of TFT 14, and thereby TFT 14 changes from OFF to ON, the charge in the capacitor 20 is discharged through TFT 14, and the voltage at the node b changes to the L level. As a result, TFT 18 is turned OFF which has been flowing the constant current iref therethrough, and the EL element 21 ceases to emit light because the current flowing through TFT 18 becomes zero (the EL elements are OFF).

The ratio in duration of the ON time to the OFF time of the EL element 21 can vary from 0% to 100% according to the voltage Vdata written into the capacitor 19 of each of the pixels 12 as a display signal. The light intensity of the EL element 21 during its ON time is kept constant by the constant current iref, and therefore the average luminance of the pixel 12 is controlled by the ratio in duration of the ON time to the OFF time of the EL element 21. Gamma correction can be made on a relationship between the analog signal voltages Vdata and the average luminance by varying the angle of slope of the triangular waveform.

Further, a voltage of a waveform increasing with time discontinuously can be used instead of the voltage of a triangular waveform illustrated in FIG. 3A. For example, a voltage of a waveform can be used which increases with time in a staircase fashion.

The voltage signal of the triangular waveform or an alternative waveform determines timing for ceasing supply of a current to a light emitting element of each pixel based upon its variance in voltage with time.

As explained above, since the average luminance of each pixel can controlled to provide many gray scale levels based upon analog signal voltages Vdata which are display signals, the first embodiment in accordance with the present invention is capable of displaying an image containing various gray scale levels.

Further, in this embodiment, current signals to be supplied to the pixel 12 are only the constant current iref required for causing the EL element 21 to produce the maximum luminance, and consequently, it is possible to charge a capacitive load coupled to the line E1 with a high speed. A dark display by the pixel is realized by reducing the light emission time of the EL element based upon the analog signal voltage Vdata.

As is apparent from the above explanation, the first embodiment of the present invention is capable of providing an EL display having many gray scale levels, and a high-resolution EL display.

Figure 4:
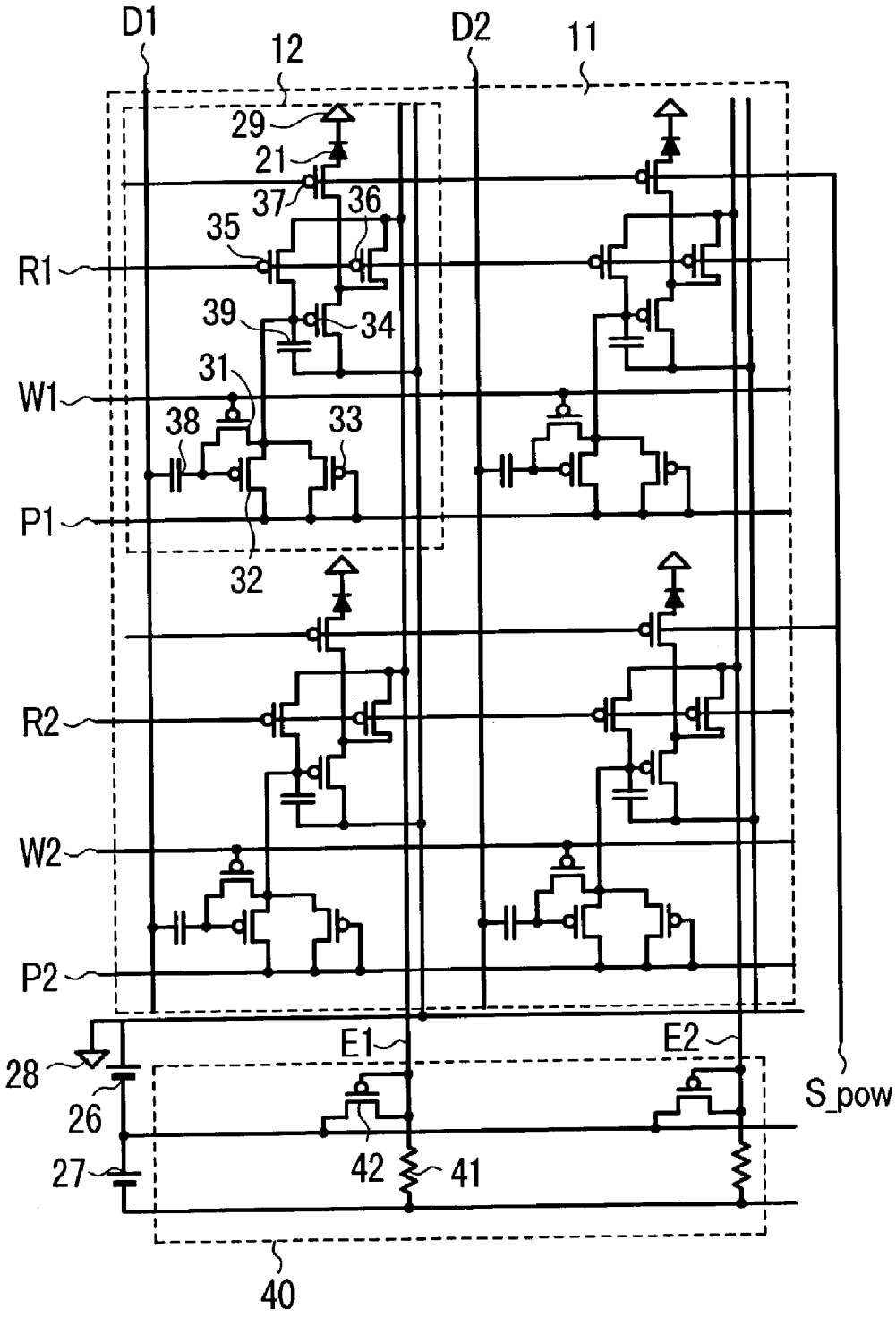
FIG. 4 is a circuit diagram illustrating pixels and their peripheries in a second embodiment in accordance with the present invention.

(2) FIG. 4 is a circuit diagram illustrating pixels and their peripheries in a second embodiment in accordance with the present invention. A plurality of pixels 12 are arranged in two dimensions in a display region 11 for displaying an image. In the second embodiment of the present invention, the pixel 12 is composed of a pixel circuit formed of TFT 33–TFT 37 and capacitors 38, 39, and an EL element 21. A cathode of the EL element 21 is connected to a common electrode 29. All of TFT 31–TFT 37 are p-channel type thin film transistors.

Arranged in a matrix configuration in the display region 11 are signal lines D1, D2 for transmitting analog voltage signals containing display signals, lines E1, E2 for supplying a current serving as a reference, and signal lines W1, W2, P1, P2, R1, R2 for controlling the pixel circuit of the pixel 12. A power supply 26 for supplying an electric current to the EL element 21, and a signal line signal line S_pow for controlling supply of the power-supply current are connected to all the pixels 12.

A reference-current source 40 is disposed outside of the display region 11, and is composed of a plurality of TFT-resistor combinations arranged laterally in FIG. 4. Each of the combinations is formed of a resistor 41 for generating a constant current and TFT 42 which is a protective diode for preventing a large negative voltage from appearing on the lines E1 and E2. The reference-current source 40 is connected to a power supply 27 for generating a reference current, and the lines E1 and E2 for supplying a constant current. A positive side of the power supply 27 is connected to a grounding electrode 28. The grounding electrode 28 and the common electrode 29 are electrically connected together.

FIG. 2 is an illustration of a configuration of an embodiment in accordance with the present invention. The display region 11 is disposed on a surface of a glass substrate 1, and a plurality of pixels 12 are fabricated in the display region 11.

With the configuration of the embodiment of the present invention in FIG. 2, in the second embodiment of the present invention, disposed on the surface of the glass substrate 1 are the signal lines W1–Wn, P1–Pn, and R1–Rn, the signal lines D1–Dm, the lines E1–Em, a scanning circuit 2 for generating control signals for the signal lines P1–Pn, W1–Wn, and R1–Rn, a signal circuit 3 for generating signals for the signal lines D1–Dm, and the reference current source 40 for generating currents in the lines E1, E2. The scanning circuit 2, the signal circuit 3, and the reference current source 40 can be formed by fabricating thin film transistors on the glass substrate 1, or can be formed by attaching semiconductor LSIs on the glass substrate 1. Capability of the scanning circuit 2 for supplying signals to the signal lines P1–Pn, W1–Wn, and R1–Rn is improved by arranging the scanning circuits 2 on opposite sides of the display region 11. The signal circuit 3 and the reference current source 40 may be disposed either above or below the display region 11 in FIG. 2. The scanning circuit 2 is a logical circuit for generating binary digital signals for the signal lines P1–Pn, W1–Wn, and R1–Rn. The signal circuit 3 is an analog circuit for supplying display signals in the form of analog voltage signals to the signal lines D1–Dm. Although not shown in FIG. 2, the common electrode 29 is formed to cover the display region 11, and is connected to the cathodes of the EL elements 21 of the pixels 12. Light emitted from the EL element 21 of the pixel 12 passes through the glass substrate 1 toward its rear surface, and a display image is viewed from the reverse side of paper of FIG. 2. If the common electrode 29 is made of transparent material, the display image can also be viewed from the front side of FIG. 2. An organic EL diode can be used as the EL element 21. If red, green, and blue light emitting materials are used for corresponding ones of the EL elements 21, a color display can be produced. Incidentally, in the second embodiment of the present invention, the signal lines L1–Lm shown in FIG. 2 are not necessary.

Incidentally, the display region 11 is illustrated as formed of only four (2×2) pixels 12 in FIG. 4, but the display region 11 intended for practical use has a larger number of pixels. In the case of resolution of color VGA (640 pixels×3 colors (red, green and blue)×480 pixels), the number m of pixels arranged in a horizontal direction in FIG. 2=1,920, and the number n of pixels arranged in a vertical direction in FIG. 2=480. The numbers of the signal lines D1–Dm and the lines E1–Em are 1,920, respectively. The numbers of the signal lines P1–Pn, W1–Wn, and R1–Rn are 480, respectively.

The second embodiment of the present invention differs from the first embodiment of the present invention, in that the thin film transistors forming the pixels are of the p-channel type, the lines for supplying the supply voltage to the EL elements 21 are separated from the lines E1, E2, the lines E1, E2 are configured so as to flow the currents serving as a reference only, and the reference current source 40 has a configuration different from that of the reference current 22.

The drive voltage waveform, an operating voltage waveform, and an operating current waveform of the pixels in the second embodiment in accordance with the present invention are the same as those for the first embodiment shown in FIG. 3, except that the polarities of all the waveforms are inverted, the more negative values are nearer the top of FIG. 3A, and the H level and the L level are interchanged, because the thin film transistors forming the second embodiment of the present invention are of the p-channel type, while the thin film transistors forming the first embodiment of the present invention are of the n-channel type. Further, since the lines for supplying the supply voltage to the EL elements 21 are separated from the lines E1, E2, the signals for the lines L1, L2 shown in FIG. 3A are not necessary in this embodiment.

In the reference current source 40, by selecting the voltage of the power supply 27 to be sufficiently high, the current iref can be obtained which is a constant current nearly equal to Vx/Rx, where Vx is a voltage of the power source 27, and Rx is a resistance of the resistor 41. The resistor 25 can be fabricated by patterning into a narrow strip a polysilicon film used for source and drain electrodes of thin film transistors, or a metal lead used for a gate electrode of thin film transistors.

During the time A, TFT 31–TFT 33 and the capacitor 38 operate, and the capacitor 38 stores the analog voltage containing display data.

During the time B, TFT 34–TFT 37, and the capacitor 39 operate, and the capacitor 39 stores a voltage Vref between its gate and source electrodes necessary for TFT 34 to flow the current iref between its drain and source electrodes.

During the time C, the signal line Dl is supplied with a triangular waveform voltage, and the ratio in duration of the ON time to the OFF time of the EL element 21 can vary from 0% to 100% according to the analog voltage Vdata stored in the capacitor 38 of each of the pixels 12. The light intensity of the EL element 21 during its ON time is kept constant by the constant current iref, and therefore the average luminance of the pixel 12 is controlled by the ratio in duration of the ON time to the OFF time of the EL element 21.

Therefore, since the average luminance of each pixel can controlled to provide many gray scale levels based upon the analog signal voltages Vdata which are display signals, the second embodiment in accordance with the present invention is capable of displaying an image containing various gray scale levels.

Further, in this embodiment, current signals to be supplied to the pixel 12 are only the constant current iref required for causing the EL element 21 to produce the maximum luminance, and consequently, it is possible to charge a capacitive load coupled to the line E1 with a high speed. A dark display by the pixel is realized by reducing the light emission time of the EL element based upon the analog signal voltage Vdata.

As is apparent from the above explanation, the second embodiment of the present invention is capable of providing an EL display having many gray scale levels, and a high-resolution EL display.

Figure 5:
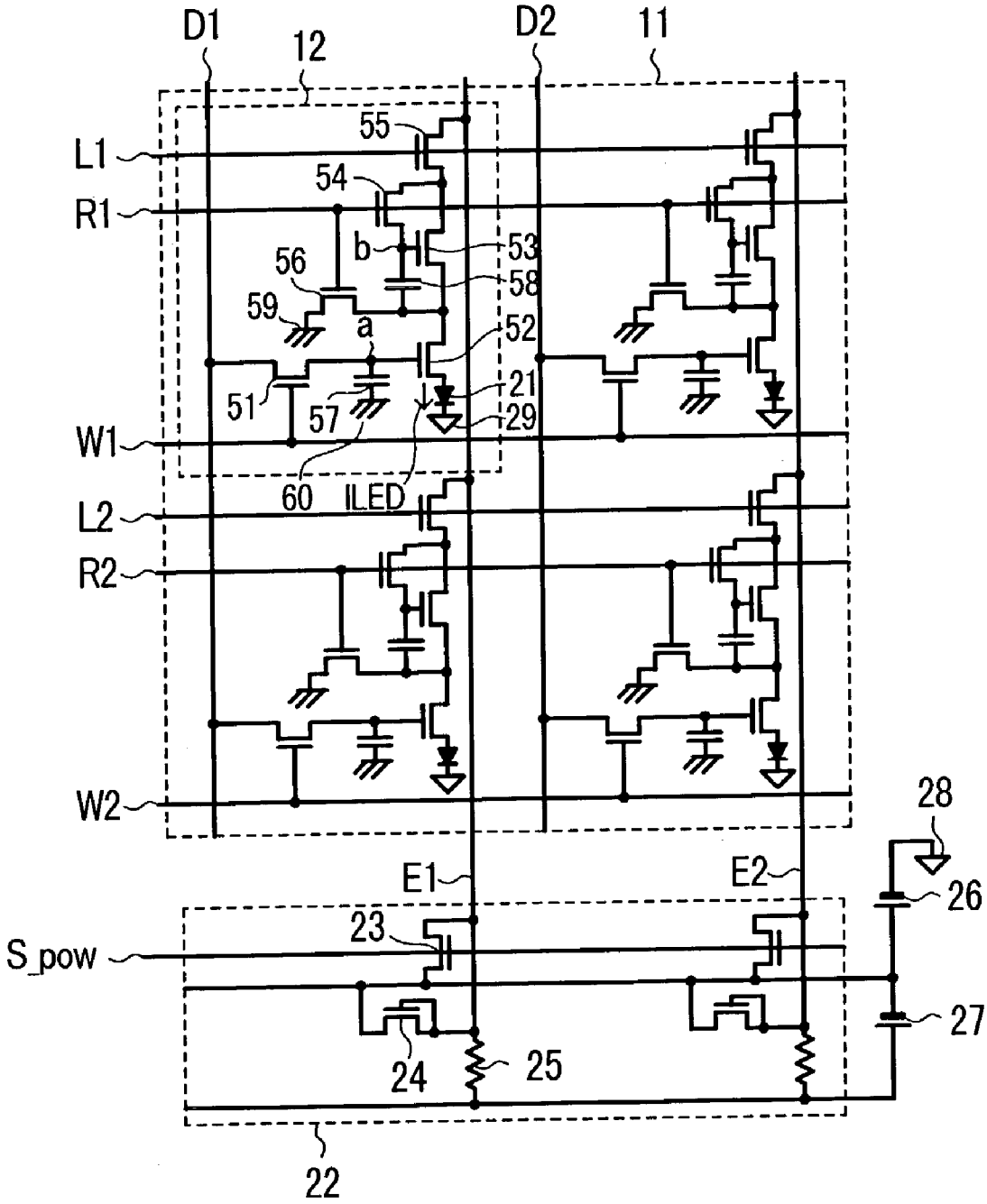
FIG. 5 is a circuit diagram illustrating pixels and their peripheries in a third embodiment in accordance with the present invention.

(3) FIG. 5 is a circuit diagram illustrating pixels and their peripheries in a third embodiment in accordance with the present invention. A plurality of pixels 12 are arranged in two dimensions in a display region 11 for displaying an image. The pixel 12 is composed of a pixel circuit formed of TFT 51–TFT 56 and capacitors 57, 58, and an EL element 21. A cathode of the EL element 21 is connected to a common electrode 29. All of TFT 51–TFT 56 are n-channel type thin film transistors. A source electrode of TFT 56 and one terminal of the capacitor 57 are connected to grounding electrodes 59, 60, respectively, which in turn are fixed at ground potential with grounding lines, or are connected to the common electrode 29.

Arranged in a matrix configuration in the display region 11 are signal lines D1, D2 for transmitting digital signals containing display signals, lines E1, E2 for supplying a current serving as a reference, and a current to be flowed into the EL element 21, and signal lines W1, W2, L1, L2, R1, R2 for controlling the pixel circuit of the pixel 12.

A reference-current source 22 is disposed outside of the display region 11, and is composed of a plurality of TFT-resistor combinations arranged laterally in FIG. 5. Each of the TFT-resistor combinations is formed of TFT 23, TFT 24, and a resistor 25. The reference-current source 22 is connected to a signal line S_pow carrying a signal for switching between the reference current and a power-supply current, a power supply 26 for supplying a current to the EL element 21, a power supply 27 for generating the reference current, and lines E1, E2 for supplying currents. The negative side of the power supply 27 is connected to a grounding electrode 28. The grounding electrode 28 and the common electrode 29 are electrically connected together.

FIG. 2 is an illustration of a configuration of an embodiment in accordance with the present invention. The display region 11 is disposed on a surface of a glass substrate 1, and a plurality of pixels 12 are fabricated in the display region 11.

With the configuration of the embodiment of the present invention in FIG. 2, in the third embodiment of the present invention, disposed on the surface of the glass substrate 1 are the signal lines L1–Ln, W1–Wn, and R1–Rn, the signal lines D1–Dm, lines E1–Em, a scanning circuit 2 for generating control signals for the signal lines L1–Ln, W1–Wn, and R1–Rn, a signal circuit 3 for generating signals for the signal lines D1–Dm, and a reference current source 22 for generating currents in the lines E1, E2. The scanning circuit 2, the signal circuit 3, and the reference current source 22 can be formed by fabricating thin film transistors on the glass substrate 1, or can be formed by attaching semiconductor LSIs on the glass substrate 1. Capability of the scanning circuit 2 for supplying signals to the signal lines L1–Ln, W1–Wn, and R1–Rn is improved by arranging the scanning circuits 2 on opposite sides of the display region 11. The signal circuit 3 and the reference current source 22 may be disposed either above or below the display region 11 in FIG. 2. The scanning circuit 2 is a logical circuit for generating binary digital signals for the signal lines L1–Ln, W1–Wn, and R1–Rn. The signal circuit 3 is a logical circuit for supplying display signals in digital form to the signal lines D1–Dm. Although not shown in FIG. 2, the common electrode 29 is formed to cover the display region 11, and is connected to the cathodes of the EL elements 21 of the pixels 12. Light emitted from the EL element 21 of the pixel 12 passes through the glass substrate 1 toward its rear surface, and a display image is viewed from the reverse side of paper of FIG. 2. If the common electrode 29 is made of transparent material, the display image can also be viewed from the front side of FIG. 2. An organic EL diode can be used as the EL element 21. If red, green, and blue light emitting materials are used for corresponding ones of the EL elements 21, a color display can be produced. In the fourth embodiment of the present invention, the signal lines P1–Pm shown in FIG. 2 are not necessary Incidentally, the display region 11 is illustrated as formed of only four (2×2) pixels 12 in FIG. 5, but the display region 11 intended for practical use has a larger number of pixels. In the case of resolution of color VGA (640 pixels×3 colors (red, green and blue)×480 pixels), the number m of pixels arranged in a horizontal direction in FIG. 2=1,920, and the number n of pixels arranged in a vertical direction in FIG. 2=480. The numbers of the signal lines D1–Dm and the lines E1–Em are 1,920, respectively. The numbers of the signal lines L1–Ln, W1–Wn, and R1–Rn are 480, respectively.

Figure 6A:
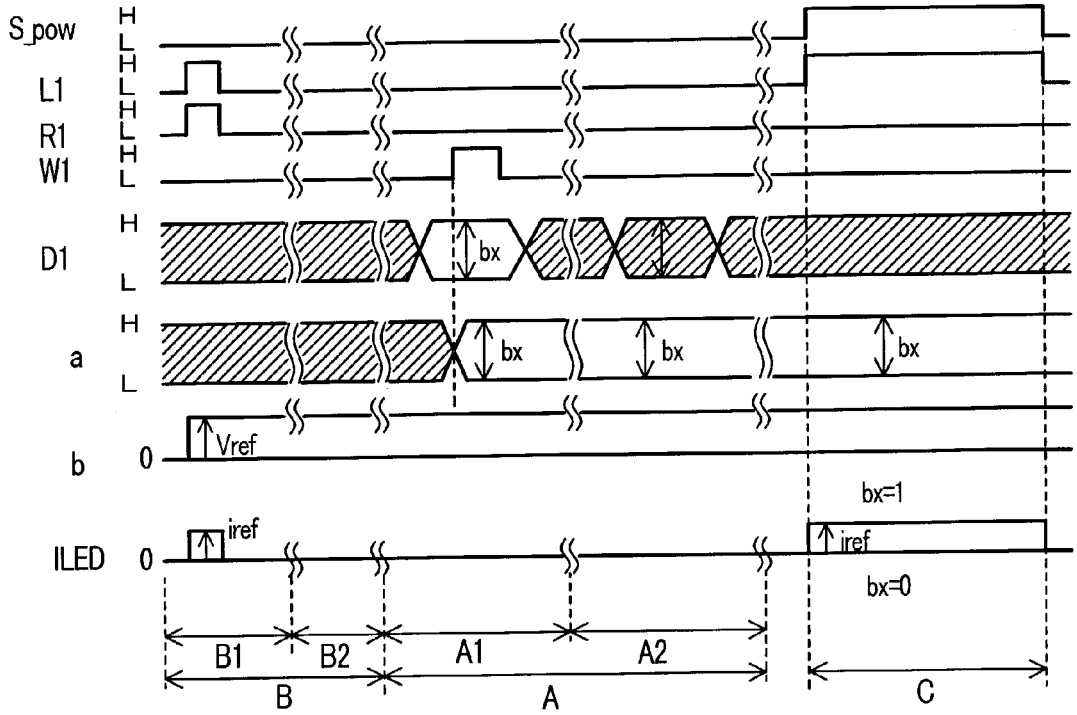
FIG. 6 illustrates a drive voltage waveform, an operating voltage waveform, an operating current waveform, and their timing charts during one frame period, of the pixels in the third embodiment in accordance with the present invention.
Figure 6B:
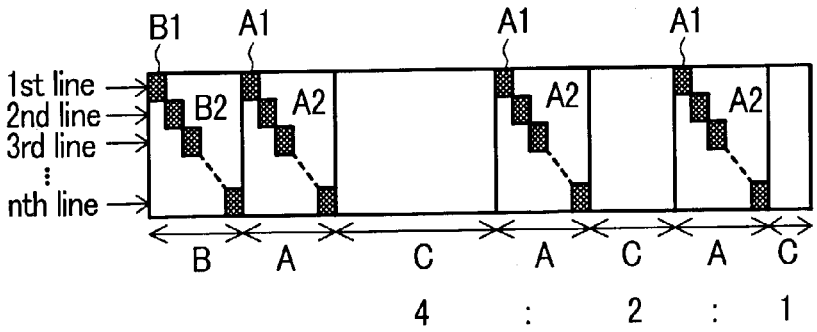

FIG. 6A illustrates a drive voltage waveform, an operating voltage waveform, and an operating current waveform of the pixels in the third embodiment in accordance with the present invention, and FIG. 6B is a timing chart of the waveforms of FIG. 6A during one frame period. The abscissa of FIG. 6A represents time, there is discontinuity in time in portions indicated by wavy lines, and this means that it is possible to change the order of arrangement of times B1, B2, A1, A2, and C. S_pow, L1, R1, and W1 represent voltages supplied to their corresponding lines on corresponding ones of the ordinates. "a" and "b" of FIG. 6A represent voltages appearing at nodes a and b in FIG. 5 on the respective ordinates. ILED indicates a current flowing into the EL element 21 on the ordinate. In FIG. 6A, the more positive values are nearer the top of FIG. 6A. The signals of S_pow, L1, R1, W1, and D1 are binary logical voltages, H and L levels, and the signal of D1 is an analog signal voltage. The H level is a voltage higher than a voltage capable of turning ON any of TFTs in the pixel 12, and the L level is a voltage lower than a voltage capable of turning OFF any of TFTs in the pixel 12. Hatched portions in FIG. 6A indicate they can take plural values, or they are not relevant to operations.

A suffix "1" in D1, L1, R1, W1, and Dl in FIG. 6A indicates that they are signals supplied to the pixel 12 in the first column and the first row, and therefore voltages D, L, R, W and D for other pixels are followed by numerals indicating rows or columns associated with them.

In the timing chart in FIG. 6B, the ordinate represents line numbers in the display region 11, "mth" indicating that a given pixel 12 is in the mth line from the top of the display region 11, and the abscissa represents time in one frame period.

One frame period is divided into a time B for writing the reference current into the pixels, a time A for writing display signals into the pixels, and a time C for the EL elements to emit light and thereby to display an image. The time B is divided into times Bi each of which is used for writing the reference signal into the pixels in a given line and times B2 each of which is used for writing the reference current into pixels in lines other than the given line. The time A is divided into times A1 each of which is used for writing display signals into pixels in a given line and times A2 each of which is used for writing display signals into pixels in lines other than the given line.

During the time A, the times A1 are assigned to successive time positions of the first (at the beginning of the time A), second, third, . . . , nth lines (at the end of the time A), respectively, and the rest of the time A after the times A1 are the times A2. In the similar way, during the time B, the times B1 are assigned to successive time positions of the first (at the beginning of the time B), second, third, . . . , nth lines (at the end of the time B), respectively, and the rest of the time B after the times B1 are the times B2.

One time A and one time C form one pair, and the pairs are repeated plural times. The number of repetition of the pairs is determined by the number of digital bits of a display signal. The number of digital bits is a figure required for representing a display signal by the binary system, and three and six digital bits are necessary for display signals producing 8 and 64 gray scale levels, respectively.

FIG. 6 illustrates a case where a display signal produces an eight gray scale levels, and is formed of three digital bits. During each of the times A, the signal line D1 is supplied with binary voltage signals b2, b1 and b0 corresponding to respective digital bits of digital data DATA representing a display signal. The duration of a respective one of the times C corresponds to a relative weight of a digital bit of the time A immediately prior to the respective one of the times C, and in the case of three digital bits, the relative weights are 4:2:1 assigned to the three digital bits, respectively.

During the time B, the signal line S_w is at the L level, since TFT 23 of the reference current source 22 is in the OFF state, the line E1 is supplied with a current from the power supply 27 via a resistor 25. The current iref flowing through the line E1 can be obtained which is a reference current nearly equal to Vx/Rx, where Vx is a voltage of the power source 27, and Rx is a resistance of the resistor 25, by selecting the voltage of the power supply 27 to be sufficiently high.

The resistor 25 can be fabricated by patterning into a narrow strip a polysilicon film used for source and drain electrodes of thin film transistors, or a metal lead used for a gate electrode of thin film transistors. In this embodiment, TFT 24 is provided as a protective diode circuit for preventing the high voltage of the power supply 27 from appearing on the lines E1, E2.

During the time BI, TFT 53–TFT 57 and the capacitor 58 of the pixel circuit operate. During the time B1, by changing the signal lines L1 and R1 to the H level, TFT 54–TFT 56 are turned ON, thereby the constant current iref generated by the reference current source 22 flows through TFT 53. At this time, TFT 53 operates in its saturation region, and there appears between the gate and source electrodes of TFT 53, a voltage Vref necessary for TFT 53 to flow the current iref between the drain and source electrodes, and the voltage Vref is applied to the capacitor 58. Thereafter, when the signal lines L1 and R1 change to the L level, and thereby TFT 54–TFT 56 are turned OFF, the current flowing through TFT 53 changes to zero, but the voltage Vref is stored in the capacitor 58.

During the time B2, although the current iref is being written into the pixels in the lines other than the given line, since the control signals on the signal lines L1 and R1 are at the L level, TFT 54–TFT 57 continue to be in the OFF state, and therefore the voltage Vref of the capacitor 20 is retained.

During the time A1, TFT 51 and TFT 52 and the capacitor 57 of the pixel circuit operate. The signal line D1 is supplied with binary voltages bx (x=2, 1, 0) corresponding to respective bit data of the digital signal DATA, and when the signal line WI connected to the gate electrode of TFT 51 is supplied with the H level pulse, the digital voltage signal bx is applied to the capacitor 57. The digital voltage signals bx are binary voltages, that is, the H or L level voltages. After the signal line W1 has changed to the L level, the digital voltage signal bx is stored in the capacitor 57. The ON and OFF states of TFT 52 are controlled by the digital voltage signal bx of the capacitor 57, if bx=the H level, TFT 52 is turned ON, and if bx=the L level, TFT 52 is turned OFF. Here, bx means the bit data b2, b1 and b0 of a digital signal DATA are supplied successively during each of the plural times A1 within one frame period.

During the time A2, since digital voltage signals are being written into the pixels in the lines other than the given line, the signals on the signal line W1 are unchanged. At this time, although the voltage on the signal line D1 changes, TFT 51 is in the OFF state, and therefore the digital voltage signal DATA stored in the capacitor 57 is retained.

During the time C, the signal line S_pow is changed to the H level, and thereby TFT 23 is turned ON, and the reference current source 22 does not function, and the lines E1 and E2 are supplied with a current from the power supply 26, but not from the reference current source 22. Since the signal line L1 is changed to the H level, TFT 55 is turned ON.

In a case where the digital voltage signal bx stored in the capacitor 57 is at the H level, since TFT 52 is ON, a current flows into the EL element 21 from the line E1 via TFT 55, TFT 53 and TFT 52. At this time, TFT 53 generates the constant current iref based upon the voltage stored in the capacitor 58, the current iref flows into the EL element 21, and the EL element 21 generates emit light uniform in intensity (the EL element is ON).

In a case where the digital voltage signal bx stored in the capacitor 57 is at the L level, since TFT 52 is OFF, the current is blocked by TFT 52, a current flowing through the EL element 21 is zero, and therefore the EL element 21 does not emit light (the EL element is OFF).

As explained above, the ON and OFF of the EL element 21 is controlled by the digital voltage signals bx supplied to the signal line D1.

During one frame period, the times A and C are repeated three times, and the digital voltage signals b2, b1 and b0 are supplied to the signal line D1 during each of the times A, and during the times C immediately after the times A, the ON and OFF of the EL element 21 is controlled based upon the supplied digital voltage signals b2, b1 and b0. Time duration of the time C is varied with a relative weight of each of the digital bits.

The total light emission time of the EL element 21 within one frame period has eight steps in time length in accordance with the digital signal DATA, and consequently, the luminance of the EL element 21 averaged over one frame period varies over eight gray scale levels in proportion to the digital display data DATA representing a display signal. Therefore, the average luminance of each of the pixels is controlled to change based upon the digital signal DATA representing a display signal, and the third embodiment of the present invention is capable of producing an image containing various gray scale levels.

Further, by increasing the number of repetition of the times A and C during one frame period, an image having a larger number of gray scale levels can be produced.

It is apparent that the third embodiment of the present invention can be formed of p-channel transistors as in the case of the second embodiment obtained by modifying the first embodiment of the present invention in configuration.

Further, in this embodiment, current signals to be supplied to the pixel 12 are only the constant current iref required for causing the EL element 21 to produce the maximum luminance, and consequently, it is possible to charge a capacitive load coupled to the line E1 with a high speed. A dark display by the pixel is realized by reducing the light emission time of the EL element based upon the digital signal voltage Vdata.

As is apparent from the above explanation, the third embodiment of the present invention is capable of providing an EL display having many gray scale levels, and a high-resolution EL display.

Figure 7:
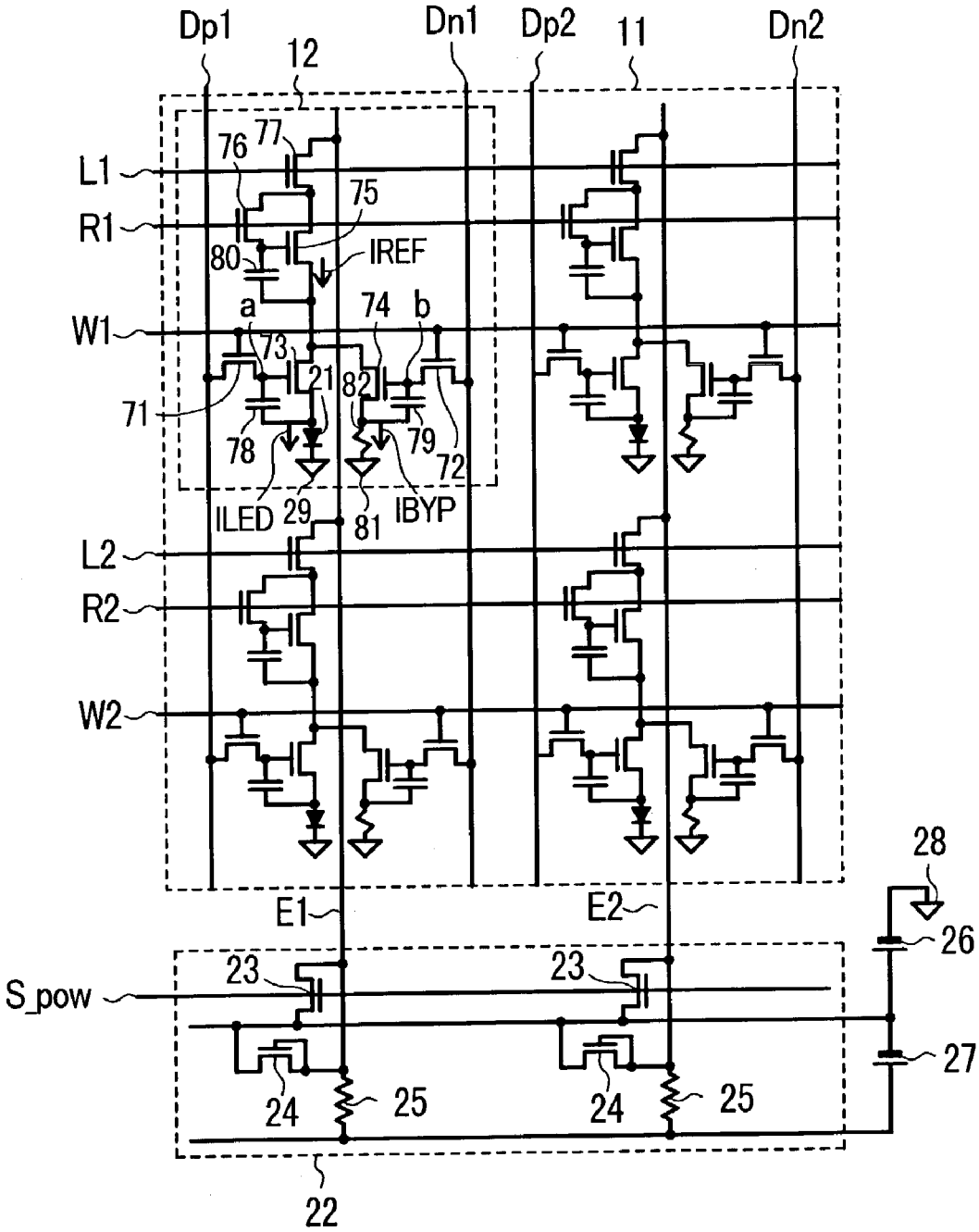
FIG. 7 is a circuit diagram illustrating pixels and their peripheries in a fourth embodiment in accordance with the present invention.

(4) FIG. 7 is a circuit diagram illustrating pixels and their peripheries in a fourth embodiment in accordance with the present invention. A plurality of pixels 12 are arranged in two dimensions in a display region 11 for displaying an image. The pixel 12 is composed of a pixel circuit formed of TFT 71–TFT 77, capacitors 78–80, and a resistor 82, and an EL element 21. A cathode of the EL element 21 is connected to a common electrode 29. All of TFT 71–TFT 77 are n-channel type thin film transistors. A source electrode of TFT 74 is connected to a grounding electrode 81 which in turn is fixed at ground potential by providing a grounding line, or are connected to a common electrode 28. The resistor 82 is a resistor having a resistance approximately equal to that of the EL element 21, and can be fabricated by patterning into a narrow strip a metal film used for gate wiring, by using a polysilicon film used for source and drain electrodes of thin film transistors, or by using a dummy EL element identical to the EL element 21, but blocking light emitted from the dummy EL element by a wiring pattern overlapped on the dummy EL element such that the light is not viewed from the outside.

Arranged in a matrix configuration in the display region 11 are signal lines Dp1, Dp2, Dn1, Dn2 for transmitting analog voltage signals containing display signals, lines E1, E2 for supplying a current serving as a reference and a current to be flowed into the EL element 21, and signal lines W1, W2, L1, L2, R1, R2 for controlling the pixel circuit of the pixel 12.

A reference-current source 22 is disposed outside of the display region 11, and is composed of a plurality of TFT-resistor combinations arranged laterally in FIG. 7. Each of the TFT-resistor combinations is formed of TFT 23, TFT 24, and a resistor 25. The reference-current source 22 is connected to a signal line S w carrying a signal for switching between the reference current and a power-supply current, a power supply 26 for supplying a current to the EL element 21, a power supply 27 for generating the reference current, and lines E1, E2 for supplying the currents. The negative side of the power supply 27 is connected to the common electrode 28. The common electrode 28 and the common electrode 29 are electrically connected together.

FIG. 2 is an illustration of a configuration of this embodiment in accordance with the present invention. The display region 11 is disposed on a surface of a glass substrate 1, and a plurality of pixels 12 are fabricated in the display region 11.

With the configuration of the embodiment of the present invention in FIG. 2, in the fourth embodiment of the present invention, disposed on the surface of the glass substrate 1 are the signal lines L1–Ln, W1–Wn, and R1–Rn, the signal lines Dp1–Dpm, Dn1–Dnm, lines E1–Em, a scanning circuit 2 for generating control signals for the signal lines L1–Ln, W1–Wn, and R1–Rn, a signal circuit 3 for generating signals for the signal lines Dp1–Dpm, Dn1–Dnm (which are illustrated as D1–Dm in FIG. 7), and a reference current source 22 for generating currents in the lines E1–Em. The scanning circuit 2, the signal circuit 3, and the reference current source 22 can be formed by fabricating thin film transistors on the glass substrate 1, or can be formed by attaching semiconductor LSIs on the glass substrate 1. Capability of the scanning circuit 2 for supplying signals to the signal lines L1–Ln, W1–Wn, R1–Rn, and R1–Rn can be improved by arranging the scanning circuits 2 on opposite sides of the display region 11. The signal circuit 3 and the reference current source 22 may be disposed either above or below the display region 11 in FIG. 2. The scanning circuit 2 is a logical circuit for generating binary digital signals for the signal lines L1–Ln, W1–Wn, and R1–Rn. The signal circuit 3 is an analog circuit for supplying display signals in the form of analog voltage signals to the signal lines Dp1–Dpm, Dn1–Dnm. Although not shown in FIG. 2, the common electrode 29 is formed to cover the display region 11, and is connected to the cathodes of the EL elements 21 of the pixels 12. Light emitted from the EL element 21 of the pixel 12 passes through the glass substrate 1 toward its rear surface, and a display image is viewed from the reverse side of paper of FIG. 2. If the common electrode 29 is made of transparent material, the display image can also be viewed from the front side of FIG. 2. An organic EL diode can be used as the EL element 21. If red, green, and blue light emitting materials are used for corresponding ones of the EL elements 21, a color display can be produced. The signal lines P1–Pm shown in FIG. 2 are not necessary in the fourth embodiment of the present invention.

Incidentally, the display region 11 is illustrated as formed of only four (2×2) pixels 12 in FIG. 7, but the display region 11 intended for practical use has a larger number of pixels 12. In the case of resolution of color VGA (640 pixels×3 colors (red, green and blue)×480 pixels), the number m of pixels arranged in a horizontal direction in FIG. 2=1,920, and the number n of pixels arranged in a vertical direction in FIG. 2=480. The numbers of the signal lines D1–Dm and the lines E1–Em are 1,920, respectively. The numbers of the signal lines L1–Ln, W1–Wn, and R1–Rn are 480, respectively.

Figure 8A:
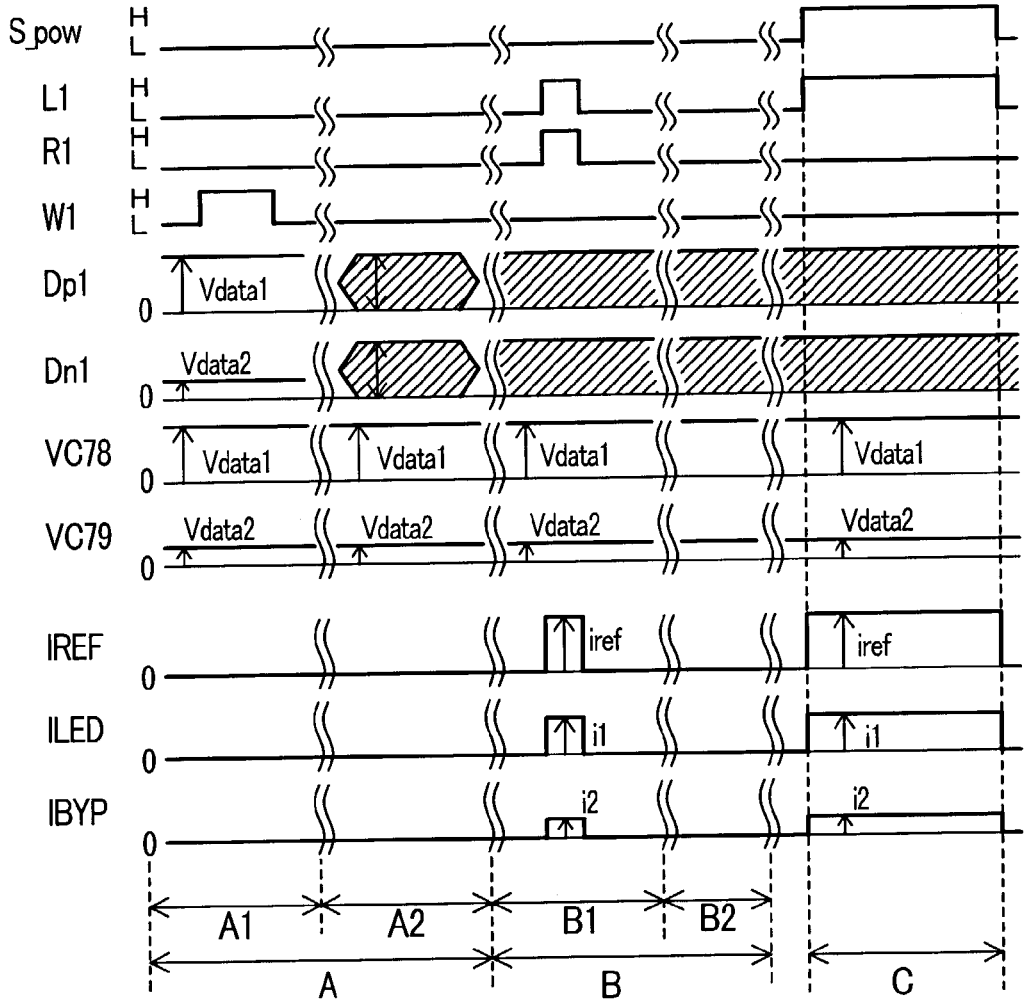
FIG. 8 illustrates a drive voltage waveform, an operating voltage waveform, an operating current waveform, and their timing charts during one frame period, of the pixels in the fourth embodiment in accordance with the present invention.
Figure 8B:
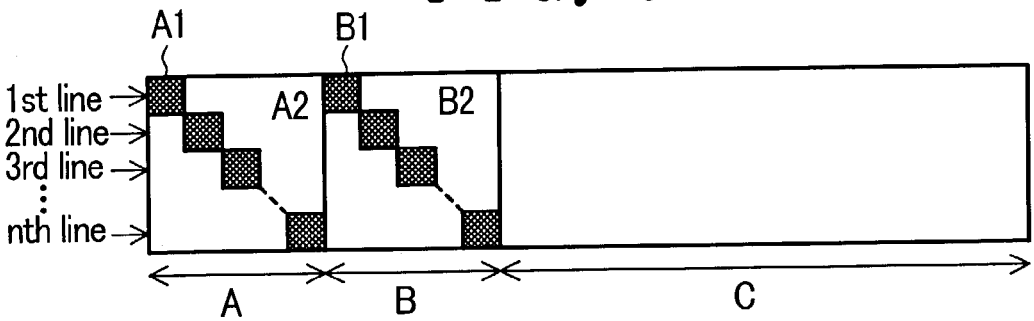

FIG. 8A illustrates a drive voltage waveform, an operating voltage waveform, and an operating current waveform of the pixels in the fourth embodiment in accordance with the present invention, and FIG. 8B is a timing chart of the waveforms of FIG. 8A during one frame period. The abscissa of FIG. 8A represents time, there is discontinuity in time in portions indicated by wavy lines, and this means that it is possible to change the order of arrangement of times A1, A2, B1, B2 and C. S_pow, L1, R1, W1, Dp1 and Dn1 represent voltages supplied to their corresponding lines on corresponding ones of the ordinates. VC78 and VC79 represent voltages between both the sides of the capacitors 78 and 79, respectively, on the ordinates. IREF, ILED, and IBYP represent currents through TFT 75, through TFT 73 and the EL element 21, and through TFT 74, respectively, on the ordinates. In FIG. 8A, the more positive values are nearer the top of FIG. 8A. The signals of S_pow, L1, R1, and W1 are binary logical voltages, H and L levels, and the signal of D1 is an analog signal voltage. The signals on the signal lines Dp1, Dn1 are analog voltages.

The H level is a voltage higher than a voltage capable of turning ON any of TFTs in the pixel 12, and the L level is a voltage lower than a voltage capable of turning OFF any of TFTs in the pixel 12. Hatched portions in FIG. 8A indicate they can take plural values, or they are not relevant to operations.

A suffix "1" in Dp1, Dn1, L1, R1, and W1 in FIG. 8A indicates that they are signals supplied to the pixel 12 in the first column and the first row, and therefore voltages Dp, Dn, L, R, and W for other pixels are followed by numerals indicating rows or columns associated with them.

In the timing chart in FIG. 8B, the ordinate represents line numbers in the display region 11, "mth" indicating that a given pixel 12 is in the mth line from the top of the display region 11, and the abscissa represents time in one frame period.

One frame period is divided into a time A for writing display signals into pixels, a time B for writing a reference current into the pixels, and a time C for the EL elements to emit light and thereby to display an image. Further, the time A is divided into times Al each of which is used for writing display signals into pixels in a given line and times A2 each of which is used for writing display signals into pixels in lines other than the given line, and the time B is divided into times B1 each of which is used for writing a reference signal into pixels in a given line and times B2 each of which is used for writing the reference current into pixels in lines other than the given line.

During the time A, the times A1 are assigned to successive time positions of the first (at the beginning of the time A), second, third, . . . , nth lines (at the end of the time A), respectively, and the rest of the time A after the times A1 are the times A2. In the similar way, during the time B, the times B1 are assigned to successive time positions of the first (at the beginning of the time B), second, third, . . . , nth lines (at the end of the time B), respectively, and the rest of the time B after the times B1 are the times B2.

During the time A1, TFT 71–TFT 74 and the capacitors 78, 79 of the pixel circuit operate. When the analog voltage signals Vdata1 and Vdata2, which are display signals, are supplied to the signal lines Dp1 and Dn1, the H level pulse is supplied to the signal line W1 connected to the gate electrodes of TFT 71 and TFT 72, then the analog voltage signals Vdata1 and Vdata2 are supplied to the capacitors 78 and 79, respectively, resulting in VC78=Vdata1 and VC79=Vdata2. Even after the signal line W1 has changed to the L level, the analog voltage signals Vdata1 and Vdata2 are stored in the capacitors 78 and 79, respectively.

During the time A2, since display signals are being written into the pixels in the lines other than the given line, the signal on the signal line W1 are unchanged. At this time, although the voltages on the signal lines Dp1 and Dn1 change, TFT 71 and TFT 72 is in the OFF state, and therefore the analog voltage signals Vdata1, Vdata2 stored in the capacitors 78, 79, respectively, are retained.

During the time B, since the signal line S_pow is at the L level, and therefore TFT 23 of the reference current source 22 is in the OFF state, the line E1 is supplied with a current from the power supply 27 via a resistor 25. The current iref flowing through the line E1 can be obtained which is a constant current nearly equal to Vx/Rx, where Vx is a voltage of the power source 27, and Rx is a resistance of the resistor 25, by selecting the voltage of the power supply 27 to be sufficiently high.

The resistor 25 can be fabricated by patterning into a narrow strip a polysilicon film used for source and drain electrodes of thin film transistors, or a metal lead used for a gate electrode of thin film transistors. In this embodiment, TFT 24 is provided as a protective diode circuit for preventing the high voltage of the power supply 27 from appearing on the lines E1, E2.

During the time B1, TFT 75–TFT 77 and the capacitor 80 of the pixel circuit operate. During the time B1, by changing the signal lines L1 and R1 to the H level, TFT 76 and TFT 77 are turned ON, thereby the constant current iref generated by the reference current source 22 flows through TFT 75. At this time, TFT 75 operates in its saturation region, and there appears between the gate and source electrodes of TFT 75, a voltage Vref necessary for TFT 75 to flow the current iref between its drain and source electrodes, and the voltage Vref is applied to the capacitor 80. Thereafter, when the signal lines L1 and R1 are changed to the L level, and thereby TFT 76 and TFT 77 are turned OFF, the current flowing through TFT 75 changes to zero, but the voltage Vref is stored in the capacitor 80.

During the time B2, although the current iref is being written into the pixels in the lines other than the given line, since the control signals on the signal lines L1 and R1 are at the L level, TFT 76 and TFT 77 continue to be in the OFF state, and therefore the voltage of the capacitor 80 is retained.

Figure 9:
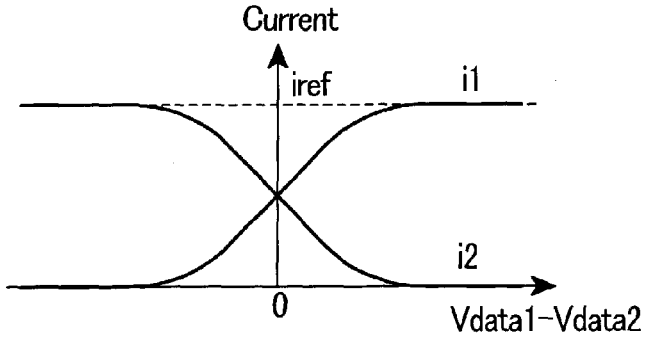
FIG. 9 is a graph showing currents i1 and i2 versus a voltage difference between Vdata1 and Vdata2

During the time C, the signal line S_pow is changed to the H level, and thereby TFT 23 is turned ON, and the reference current source 22 does not function, the lines E1 and E2 are supplied with a current from the power supply 26, but not from the reference current source 22. By changing the signal line L1 to the H level, TFT 77 is turned ON, the current from the line E1 passes through TFT 77 and TFT 75, and then branches into TFT 73 and TFT 74. One current from TFT 73 passes through the EL element 21 as the current ILED, and then flows into the grounding electrode 28, and the other current from TFT 74 passes through a resistor 82 as a current IBYP, and then flows into a grounding electrode 81. At this time, the current ILED=i1, and the current IBYP=i2, and i1 and i2 depend upon Vdatal and Vdata2, respectively. By supplying to TFT 73 and TFT 74, the analog voltage signals Vdatal and Vdata2 high enough for TFT 73 and TFT 74 to operate in a linear region, TFT 73 and TFT 74 function as variable resistors resistances of which vary based upon the analog voltage signals Vdata1 and Vdata2. In this case, the currents i1 and i2 vary with the analog voltage signals Vdata1 and Vdata2 as shown in FIG. 9 which is a graph showing relationship between the currents i1, i2 and a difference in voltage between Vdata1 and Vdata2. As the difference (Vdata1–Vdata2) increases, the resistance of TFT 73 becomes smaller compared with that of TFT 74, and therefore the current i1 increases. On the other hand, as the difference (Vdata1–Vdata2) decreases, the resistance of TFT 74 becomes smaller compared with that of TFT 73, and therefore the current i2 increases. However, regardless of the difference (Vdata1–Vdata2), the sum (i1+i2) is the constant current iref.

Intensity of light emitted from the EL element 21 is proportional to the current i1, and since the duration of light emission is kept constant by the signal from the signal line L1, luminance of the pixel 12 averaged over one frame period is proportional to the current i1.

Consequently, the average luminance of the pixel 12 can be controlled to provide many gray scale levels, by supplying analog voltage signals Vdata1, Vdata2, which are display signals, to the signal lines Dp1, Dn1, based upon the relationship of the graph of FIG. 9, and therefore the fourth embodiment of the present invention is capable of producing an image containing various gray scale levels.

Further, in this embodiment, current signals to be supplied to the pixel 12 are only the constant current iref required for causing the EL element 21 to produce the maximum luminance, and consequently, it is possible to charge a capacitive load coupled to the line E1 with a high speed. A dark display by the pixel is realized by generating a current smaller than the current iref within the pixel based upon the analog signal voltages Vdata1, Vdata2, and supplying the generated current to the EL element.

Consequently, the fourth embodiment of the present invention is capable of providing an EL display having many gray scale levels, and a high-resolution EL display.

Figure 10:
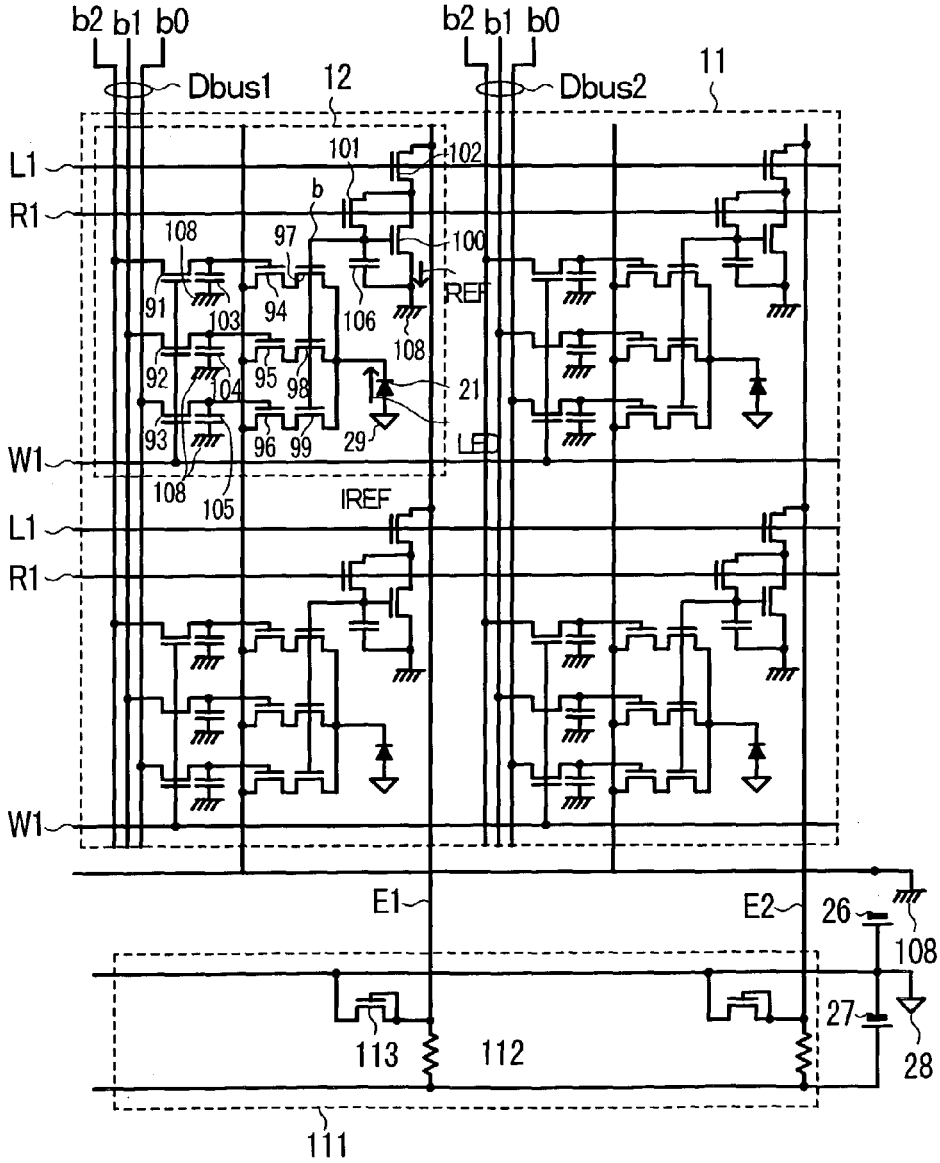
FIG. 10 is a circuit diagram illustrating pixels and their peripheries in a fifth embodiment in accordance with the present invention.

(5) FIG. 10 is a circuit diagram illustrating pixels and their peripheries in a fifth embodiment in accordance with the present invention. A plurality of pixels 12 are arranged in two dimensions in a display region 11 for displaying an image. The pixel 12 is composed of a pixel circuit formed of TFT 91–TFT 102 and capacitors 103–106, and an EL element 21. An anode of the EL element 21 is connected to a common electrode 29. All of TFT 71–TFT 77 are n-channel type thin film transistors.

The source electrodes of TFT 94–TFT 97 and TFT 100, and one terminal of each of the capacitors 103–105 are connected to the grounding electrode 108, which in turn is fixed at ground potential by using a grounding line.

TFT 100 and TFT 97–TFT 99 are formed of transistors which resemble each other very closely in characteristics, and channel widths of TFT 97, TFT 98, and TFT 99 are fabricated to be 4/7, 2/7, and 1/7 of a channel width of TFT 106, respectively.

Arranged in a matrix configuration in the display region 11 are three-signal-line buses Dbus1, Dbus2 for transmitting digital signals containing display signals, lines E1, E2 for supplying a current serving as a reference, and a current to be flowed into the EL element 21, and signal lines W1, W2, L1, L2, R1, R2 for controlling the pixel circuit of the pixel 12. Each of the signal line buses Dbus1, Dbus2 is composed of signal lines b2, b1 and b0.

A reference-current source 111 is disposed outside of the display region 11, and is composed of a plurality of TFT-resistor combinations arranged laterally in FIG. 1. Each of the TFT-resistor combinations is formed of TFT 113 and a resistor 112. The reference-current source 111 is connected to a power supply 27 for generating the reference current, and lines E1, E2 for supplying the currents. The negative side of the power supply 26 for supplying the current to the EL element 21 is connected to a grounding electrode 108, and the positive side of the power supply 26 is connected to the common electrode 29.

FIG. 2 is an illustration of a configuration of an embodiment in accordance with the present invention. The display region 11 is disposed on a surface of a glass substrate 1, and a plurality of pixels 12 are fabricated in the display region 11.

With the configuration of the embodiment of the present invention in FIG. 2, in the fifth embodiment of the present invention, disposed on the surface of the glass substrate 1 are the signal lines L1–Ln, W1–Wn, and R1–Rn, the signal lines Dbus1–Dbusm, lines E1–Em, a scanning circuit 2 for generating control signals for the signal lines L1–Ln, W1–Wn, and R1–Rn, a signal circuit 3 for generating signals for the signal lines Dbus1–Dbusm (which are illustrated as D1–Dm in FIG. 2), and a reference current source 111 for generating currents in the lines E1, E2. The scanning circuit 2, the signal circuit 3, and the reference current source 111 can be formed by fabricating thin film transistors on the glass substrate 1, or can be formed by attaching semiconductor LSIs on the glass substrate 1. Capability of the scanning circuit 2 for supplying signals to the signal lines L1–Ln, W1–Wn, and R1–Rn is improved by arranging the scanning circuits 2 on opposite sides of the display region 11. The signal circuit 3 and the reference current source 111 may be disposed either above or below the display region 11 in FIG. 2. The scanning circuit 2 is a logical circuit for generating binary digital signals for the signal lines L1–Ln, W1–Wn, and R1–Rn. The signal circuit 3 is a logical circuit for supplying display signals in digital form to the signal lines Dbus1–Dbusm. Although not shown in FIG. 2, the common electrode 29 is formed to cover the display region 11, and is connected to the anodes of the EL elements 21 of the pixels 12. Light emitted from the EL element 21 of the pixel 12 passes through the glass substrate 1 toward its rear surface, and a display image is viewed from the reverse side of paper of FIG. 2. If the common electrode 29 is made of transparent material, the display image can also be viewed from the front side of FIG. 2. An organic EL diode can be used as the EL element 21. If red, green, and blue light emitting materials are used for corresponding ones of the EL elements 21, a color display can be produced. The signal lines P1–Pm shown in FIG. 2 are not necessary in the fifth embodiment of the present invention.

Incidentally, the display region 11 is illustrated as formed of only four (2×2) pixels 12 in FIG. 10, but the display region 11 intended for practical use has a larger number of pixels 12. In the case of resolution of color VGA (640 pixels×3 colors (red, green and blue)×480 pixels), the number m of pixels arranged in a horizontal direction in FIG. 2=1,920, and the number n of pixels arranged in a vertical direction in FIG. 2=480. The numbers of the signal lines Dbus1–Dbusm and the lines E1–Em are 1,920, respectively. The numbers of the signal lines L1–Ln, W1–Wn, and R1–Rn are 480, respectively.

Figure 11A:
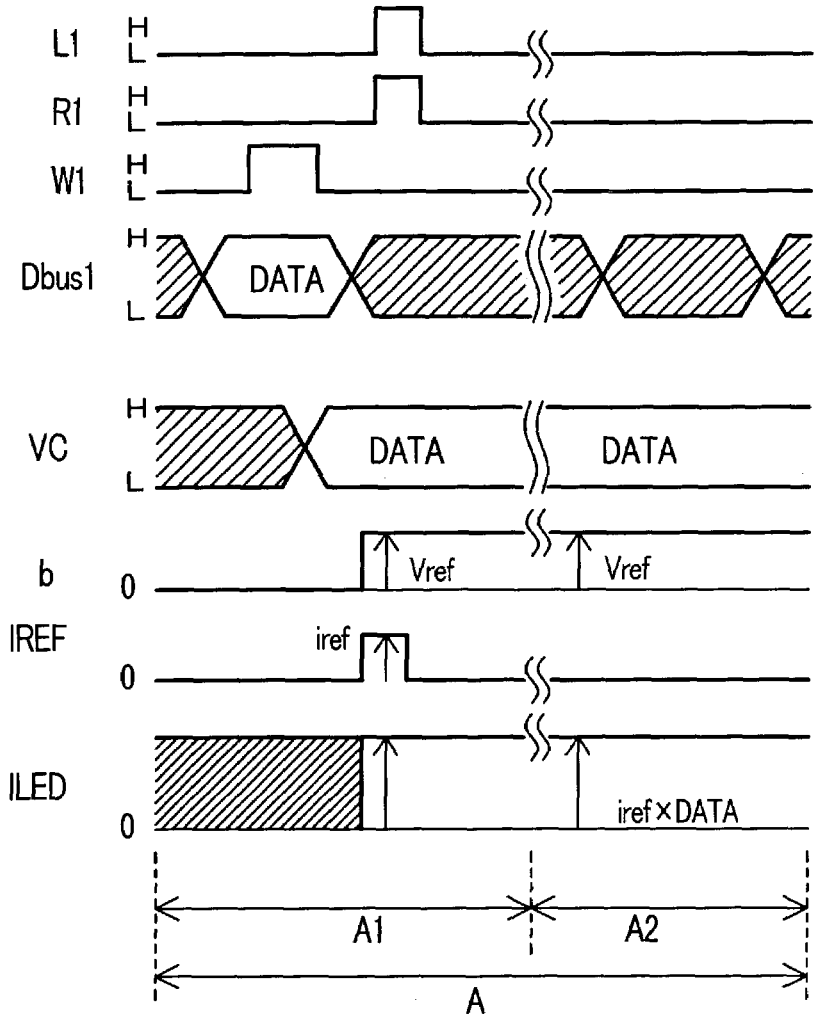
FIG. 11 illustrates a drive voltage waveform, an operating voltage waveform, an operating current waveform, and their timing charts during one frame period of the pixels in the fifth embodiment in accordance with the present invention.
Figure 11B:
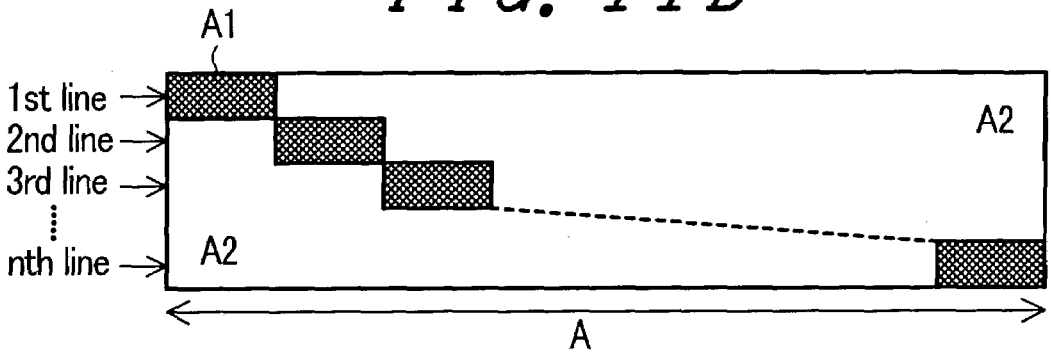

FIG. 11A illustrates a drive voltage waveform, an operating voltage waveform, and an operating current waveform of the pixels in the fifth embodiment in accordance with the present invention, and FIG. 11B is a timing chart of the waveforms of FIG. 11A during one frame period. The abscissa of FIG. 11A represents time, there is discontinuity in time in portions indicated by wavy lines, and this means that it is possible to change the order of arrangement of times A1 and A2. L1, R1, W1 and Dbus1 represent voltages supplied to their corresponding lines on corresponding ones of the ordinates. VC represents a digital signal stored in the capacitors 103–105, and "b" represent a voltage appearing at the node b in FIG. 10, on the respective ordinates. IREF and ILED indicate currents flowing through TFT 100 and into the EL element 21, respectively, on the ordinates. In FIG. 11A, the more positive values are nearer the top of FIG. 11A. The signals of L1, R1, W1, and Dbus1 are binary logical voltages, H and L levels. The H level is a voltage higher than a voltage capable of turning ON any of TFTs in the pixel 12, and the L level is a voltage lower than a voltage capable of turning OFF any of TFTs in the pixel 12. Hatched portions in FIG. 11A indicate they can take plural values, or they are not relevant to operations.

A suffix "1" in Dbus1, L1, R1 and W1 in FIG. 11A indicates that they are signals supplied to the pixel 12 in the first column and the first row, and therefore voltages Dbus, L, R and W for other pixels are followed by numerals indicating rows or columns associated with them.

In the timing chart in FIG. 11B, the ordinate represents line numbers in the display region 11, "mth" indicating that a given pixel 12 is in the mth line from the top of the display region 11, and the abscissa represents time in one frame period.

One frame period is occupied by a time A, and the time A is divided into times A1 each of which is used for writing display signals and the reference current into pixels in a given line and times A2 each of which is used for writing display signals and the reference signal into pixels in lines other than the given line.

During the time A, the times A1 are assigned to successive time positions of the first (at the beginning of the time A), second, third, . . . , nth lines (at the end of the time A), respectively, and the rest of the time A excluding the times A1 are the times A2.

During the time A, the line E1 is supplied with a current from the power supply 27 via a resistor 112 of the reference current source 111. The current iref flowing through the line E1 can be obtained which is a constant current nearly equal to Vx/Rx, where Vx is a voltage of the power source 27, and Rx is a resistance of the resistor 112, by selecting the voltage of the power supply 27 to be sufficiently high.

The resistor 112 can be fabricated by patterning into a narrow strip a polysilicon film used for source and drain electrodes of thin film transistors, or a metal lead used for a gate electrode of thin film transistors. In this embodiment, TFT 113 is provided as a protective diode circuit for preventing the high voltage of the power supply 27 from appearing on the lines E1, E2.

During the time A1, each of the signal lines b2, b1 and b0 of the signal line bus Dbus1 is supplied with a corresponding voltage of the three-bit digital voltage signal DATA, which is a display signals. When the signal line W1 connected to gate electrodes of TFT 91–TFT 93 is supplied with the H level pulse, each of the capacitors 103–105 is supplied with a voltage of a corresponding bit of the digital voltage signal DATA, and even after the signal line W1 has been changed to the L level, the digital voltage signal DATA is stored in the capacitors 103–105. ON and OFF states of TFT 94–TFT 96 are controlled by the voltages of the capacitors 103–105, they are turned ON if the voltages are at the H level, and they are turned OFF if the voltages are at the L level.

Further, during the time A1, the signal lines L1 and R1 are supplied with the H level pulse, and thereby TFT 101 and TFT 102 are turned ON, and consequently, the constant current iref generated by the reference current source 111 flows through TFT 100. At this time, TFT 100 operate in a saturation region, there appears between gate and source electrodes of TFT 100, a voltage Vref required for TFT 100 to flow the current iref between the drain and source electrodes of TFT 100, and the voltage Vref is applied to the capacitor 106. Thereafter, when the signal lines L1 and R1 are changed to the L level, TFT 101 and TFT 102 are turned OFF, and the current flowing through TFT 100 becomes zero, but the voltage Vref is stored in the capacitor 106.

During the time A2, since display signals and the current iref are being written into the pixels in the lines other than the given line, the signals on the signal lines W1, L1, and R1 are at the L level, and since TFT 91–TFT 93 are OFF, the digital signals DATA stored in the capacitors 103–105 are retained.

As described above, since TFT 100 and TFT 97–TFT 99 are formed of transistors which resemble each other very closely in characteristics, and since the channel widths of TFT 97, TFT 98, and TFT 99 are fabricated to be 4/7, 2/7, and 1/7 of a channel width of TFT 100, respectively, when the voltage Vref stored in the capacitor 106 is applied to the gate electrodes of TFT 97–TFT 99, if TFT 94 is ON, 4/7 of the current iref flows through TFT 97, if TFT 95 is ON, 2/7 of the current iref flows through TFT 98, and if TFT 96 is ON, 1/7 of the current iref flows through TFT 99.

The total of the currents through TFT 97, TFT 98 and TFT 99 is the current ILED flowing through the EL element 21, and consequently, eight levels of currents, (0/7, 1/7, 2/7, 3/7, 4/7, 5/7, 6/7, and 7/7)×iref, flow through the EL element 21 in accordance with the digital signal DATA stored in the capacitors 103–105.

Intensity of light emitted by the EL element 21 is proportional to the current ILED, and the duration of the light emission is one frame period, and therefore it is kept constant, and luminance of the pixel 12 averaged over one frame period is proportional to the current ILED. Therefore, by supplying the digital voltage signal DATA, which is a display signal, to the signal line bus Dbus, the average luminance of each pixel can controlled to provide many gray scale levels, the fifth embodiment in accordance with the present invention is capable of displaying an image containing various gray scale levels.

Further, an image having a larger number of gray scale levels can be displayed by increasing the number of signal lines forming each of the signal line buses D1, D2, and the number of parallel combinations each formed of one of thin film transistors TFT 97–TFT 99, . . . and its peripheral circuit with the channel widths of the thin film transistors differing from each other.

Further, in this embodiment, current signals to be supplied to the pixel 12 are only the constant current iref required for causing the EL element 21 to produce the maximum luminance, and consequently, it is possible to charge a capacitive load coupled to the line E1 with a high speed. A dark display by the pixel is realized by generating a current smaller than the current iref within the pixel based upon the digital signal DATA, and supplying the smaller current to the EL element.

As is apparent from the above explanation, the fifth embodiment of the present invention is capable of providing an EL display having many gray scale levels, and a high-resolution EL display.

Figure 12:
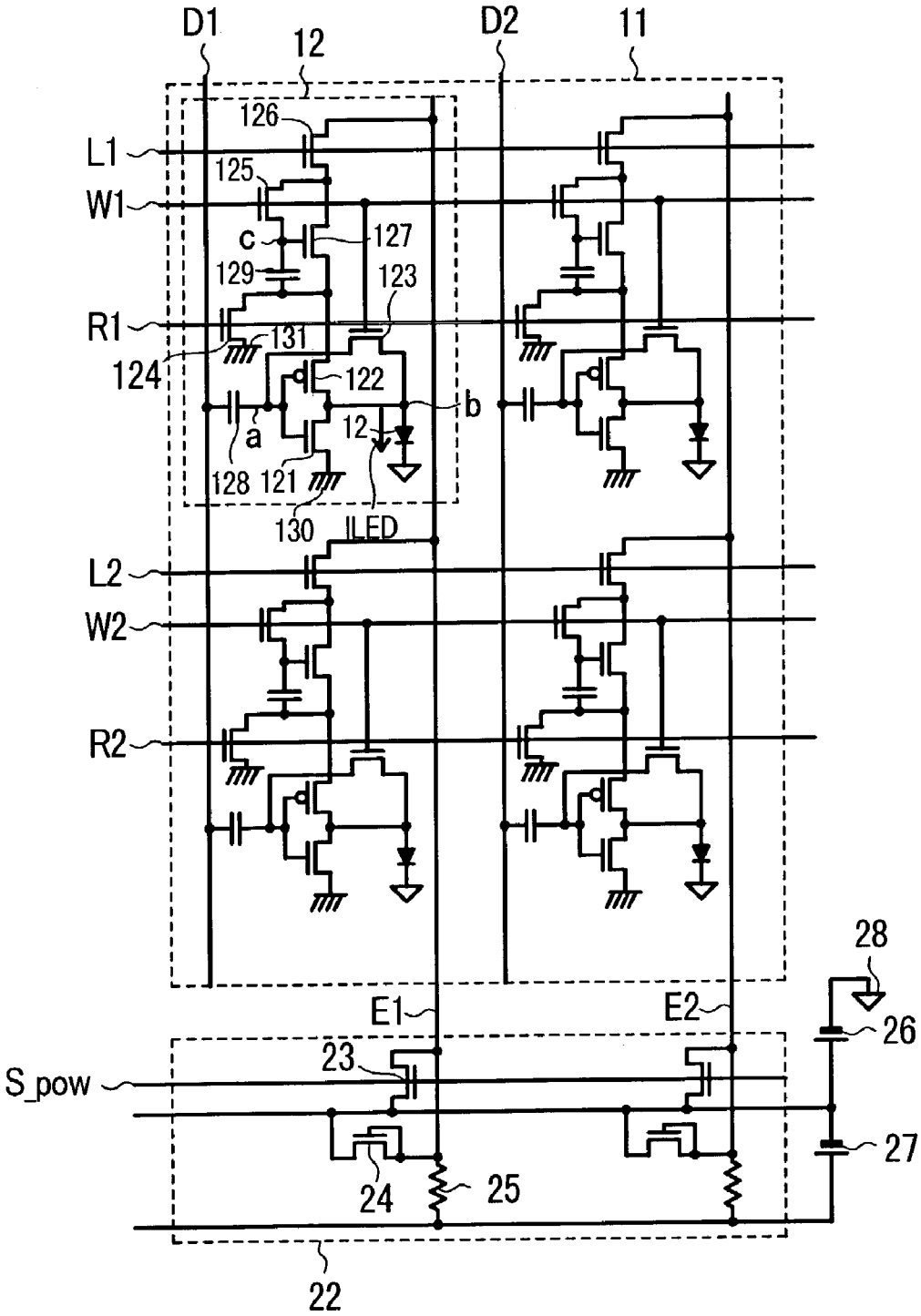
FIG. 12 is a circuit diagram illustrating pixels and their peripheries in a sixth embodiment in accordance with the present invention.

(6) FIG. 12 is a circuit diagram illustrating pixels and their peripheries in a sixth embodiment in accordance with the present invention. A plurality of pixels 12 are arranged in two dimensions in a display region 11 for displaying an image. The pixel 12 is composed of a pixel circuit formed of TFT 121–TFT 127 and capacitors 128, 129, and an EL element 21. A cathode of the EL element 21 is connected to a common electrode 29. TFT 122 is a p-channel type thin film transistor, and the remainder of the TFTs are n-channel type thin film transistors. The n-channel type TFT 121 and the p-channel type TFT 122 forms a complementary inverter circuit. A source electrode of TFT 121 is connected to a grounding electrode 130, a source electrode of TFT 124 is connected to a grounding electrode 131, and the grounding electrodes 130, 131 are fixed at grounding potential by using a grounding line, or are connected to the common electrode 29.

Arranged in a matrix configuration in the display region 11 are signal lines D1, D2 for transmitting analog voltage signals containing display signals, lines E1–E2 for supplying a current serving as a reference and a current to be flowed into the EL element 21, and signal lines W1, W2, L1, L2, R1, R2 for controlling the pixel circuit of the pixel 12.

A reference-current source 22 is disposed outside of the display region 11, and is composed of a plurality of TFT-resistor combinations arranged laterally in FIG. 12. Each of the TFT-resistor combinations is formed of TFT 23, TFT 24, and a resistor 25. The reference-current source 22 is connected to a signal line S_pow carrying a signal for switching between the reference current and a power-supply current, a power supply 26 for supplying a current to the EL element 21, a power supply 27 for generating the reference current, and lines E1, E2 for supplying a current. The negative side of the power supply 27 is connected to a common electrode 28. The common electrode 28 and the common electrode 29 are electrically connected together.

FIG. 2 is an illustration of a configuration of an embodiment in accordance with the present invention. The display region 11 is disposed on a surface of a glass substrate 1, and a plurality of pixels 12 are fabricated in the display region 11.

With the configuration of the embodiment of the present invention in FIG. 2, in the sixth embodiment of the present invention, disposed on the surface of the glass substrate 1 are the signal lines L1–Ln, W1–Wn, and R1–Rn, the signal lines D1–Dm, lines E1–E2, a scanning circuit 2 for generating control signals for the signal lines L1–Ln, W1–Wn, and R1–Rn, a signal circuit 3 for generating signals for the signal lines D1–Dm, and a reference current source 22 for generating currents in the lines E1–Em. The scanning circuit 2, the signal circuit 3, and the reference current source 22 can be formed by fabricating thin film transistors on the glass substrate 1, or can be formed by attaching semiconductor LSIs on the glass substrate 1. Capability of the scanning circuit 2 for supplying signals to the signal lines L1–Ln, Wl–Wn, and R1–Rn is improved by arranging the scanning circuits 2 on opposite sides of the display region 11. The signal circuit 3 and the reference current source 22 may be disposed either above or below the display region 11 in FIG. 2. The scanning circuit 2 is a logical circuit for generating binary digital signals for the signal lines L1–Ln, W1–Wn, and R1–Rn. The signal circuit 3 is an analog circuit for supplying display signals in the form of analog voltage signals to the signal lines D1–Dm. Although not shown in FIG. 2, the common electrode 29 is formed to cover the display region 11, and is connected to the cathodes of the EL elements 21 of the pixels 12. Light emitted from the EL element 21 of the pixel 12 passes through the glass substrate 1 toward its rear surface, and a display image is viewed from the reverse side of paper of FIG. 2. If the common electrode 29 is made of transparent material, the display image can also be viewed from the front side of FIG. 2. An organic EL diode can be used as the EL element 21. If red, green, and blue light emitting materials are used for corresponding ones of the EL elements 21, a color display can be produced. The signal lines P1–Pm indicated in FIG. 2 are not necessary in the sixth embodiment of the present invention.

Incidentally, the display region 11 is illustrated as formed of only four (2×2) pixels 12 in FIG. 12, but the display region 11 intended for practical use has a larger number of pixels. In the case of resolution of color VGA (640 pixels×3 colors (red, green and blue)×480 pixels), the number m of pixels arranged in a horizontal direction in FIG. 2=1,920, and the number n of pixels arranged in a vertical direction in FIG. 2=480. The numbers of the signal lines D1–Dm and the lines E1–Em are 1,920, respectively. The numbers of the signal lines L1–Ln, W1–Wn, and R1–Rn are 480, respectively.

Figure 13A:
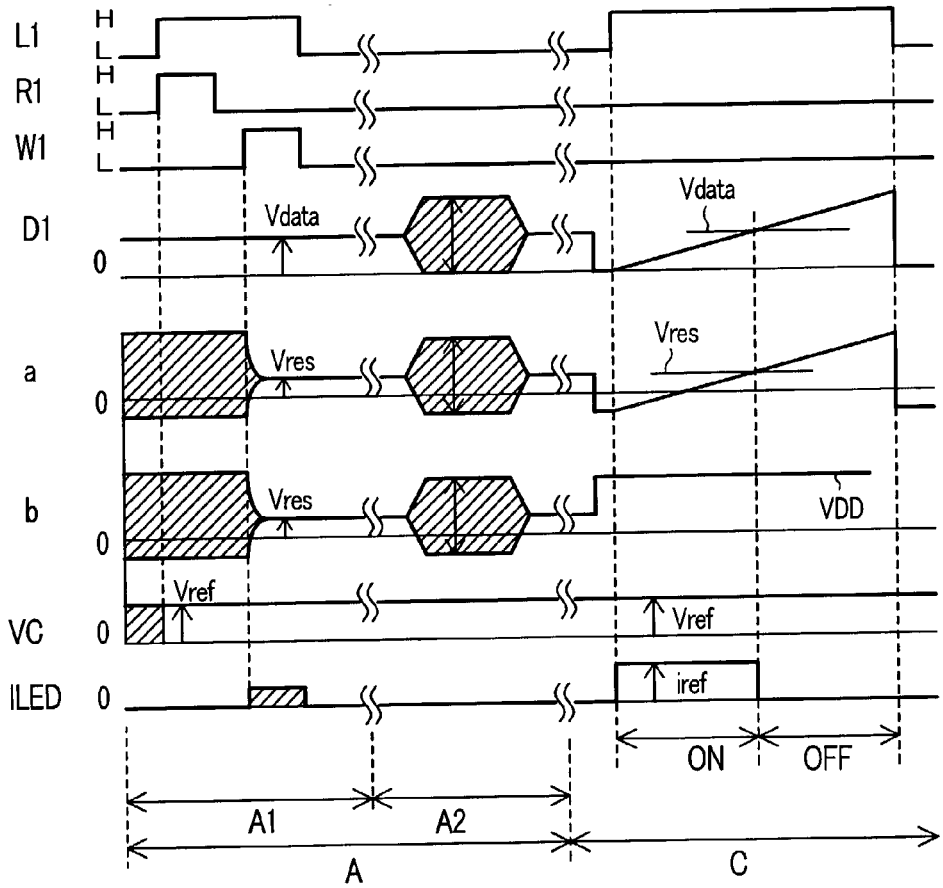
FIG. 13 illustrates a drive voltage waveform, an operating voltage waveform, an operating current waveform, and their timing charts during one frame period, of the pixels in the sixth embodiment in accordance with the present invention.

FIG. 13A illustrates a drive voltage waveform, an operating voltage waveform, and an operating current waveform of the pixels in the sixth embodiment in accordance with the present invention, and FIG. 3B is a timing chart of the waveforms of FIG. 13A during one frame period. The abscissa of FIG. 13A represents time, there is discontinuity in time in portions indicated by wavy lines, and this means that it is possible to change the order of arrangement of times A1, A2, and C. S_pow, L1, W1, R1, and D1 represent voltages supplied to their corresponding lines on corresponding ones of the ordinates. "a" and "b" of FIG. 13A represent voltages appearing at nodes a and b in FIG. 12 on the respective ordinates. VC represents a voltage between both the terminals of the capacitor 129 on the ordinate. ILED indicates a current flowing into the EL element 21 on the ordinate. In FIG. 13A, the more positive values are nearer the top of FIG. 13A. The signals of S_pow, L1, W1, and R1 are binary logical voltages, H and L levels, and the signal of D1 is an analog signal voltage. The H level is a voltage higher than a voltage capable of turning ON any of TFTs in the pixel 12, and the L level is a voltage lower than a voltage capable of turning OFF any of TFTs in the pixel 12. Hatched portions in FIG. 13A indicate they can take plural values, or they are not relevant to operations.

A suffix "1" in D1, L1, W1, and R1 in FIG. 13A indicates that they are signals supplied to the pixel 12 in the first column and the first row, and therefore voltages D, L, W and R for other pixels are followed by numerals indicating rows or columns associated with them.

Figure 13B:
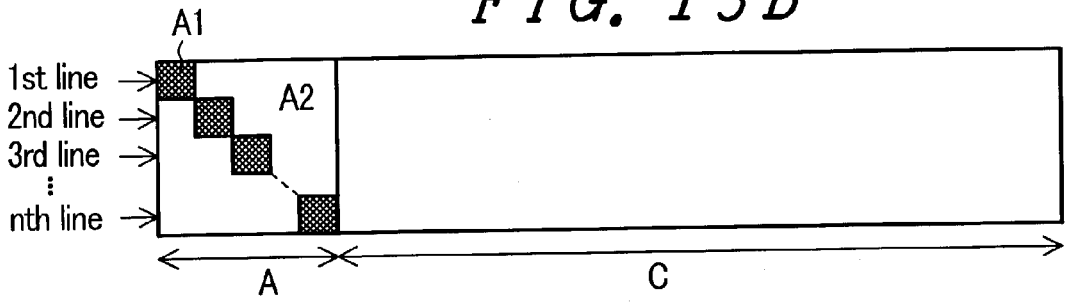
Figure 14:
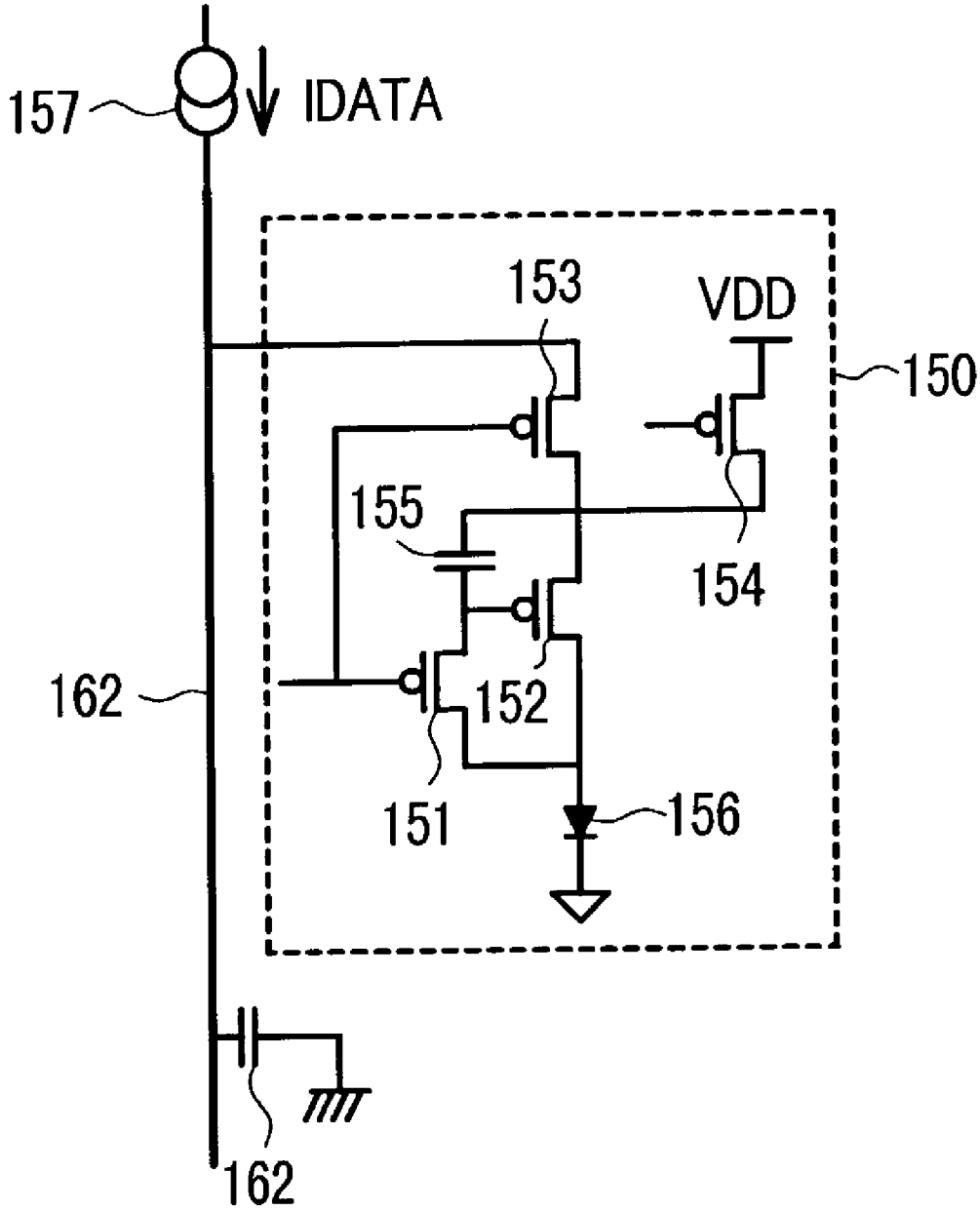
FIG. 14 is a circuit diagram illustrating circuits of conventional pixels employing EL elements.

In the timing chart in FIG. 13B, the ordinate represents line numbers in the display region 11, "mth" indicating that a given pixel 12 is in the mth line from the top of the display region 11, and the abscissa represents time in one frame period.

One frame period is divided into a time A for writing display signals and the reference current into pixels, and a time C for the EL elements to emit light and thereby to display an image. Further, the time A is divided into times A1 each of which is used for writing display signals and the reference current into pixels in a given line and times A2 each of which is used for writing display signals the reference current into pixels in lines other than the given line.

During the time A, the times A1 are assigned to successive time positions of the first (at the beginning of the time A), second, third, . . . , nth lines (at the end of the time A), respectively, and the rest of the time A after the times A1 are the times A2.

During the time A, the signal line S_pow is at the L level, and since TFT 23 of the reference current source 22 is in the OFF state, the line E1 is supplied with a current from the power supply 27 via a resistor 25. The current iref flowing through the line E1 can be obtained which is a constant current nearly equal to Vx/Rx, where Vx is a voltage of the power source 27, and Rx is a resistance of the resistor 25, by selecting the voltage of the power supply 27 to be sufficiently high.

The resistor 25 can be fabricated by patterning into a narrow strip a polysilicon film used for source and drain electrodes of thin film transistors, or a metal lead used for a gate electrode of thin film transistors. In this embodiment, TFT 24 is provided as a protective diode circuit for preventing the high voltage of the power supply 27 from appearing on the lines E1, E2.

During the time A1, initially the H level pulse is supplied to the signal line R1 by changing the signal line L1 to the H level. Thereby TFT 124–TFT 126 are turned ON, and the constant current iref generated by the reference current source 22 flows through TFT 127. At this time, TFT 127 operates in its saturation region, and there appears between the gate and source electrodes of TFT 127, a voltage Vref necessary for TFT 127 to flow the current iref between its drain and source electrodes, and the voltage Vref is applied to the capacitor 129. Thereafter, when the signal line R1 changes to the L level, and thereby TFT 124 and TFT 125 are turned OFF, but the voltage Vref is stored in the capacitor 129. Then, if the H level pulse is supplied to the signal line W1 with the signal line L1 being at the H level. Thereupon, TFT 123 is turned ON, and it short-circuits a path between nodes a and b which are, respectively, input and output points of an inverter circuit formed of TFT 121 and TFT 122, as a result both the nodes a, b change to a threshold voltage Vres of the inverter circuit, and the voltage Vres is applied to one terminal of the capacitor 128.

On the other hand, when the signal line D1 is supplied with the analog voltage signal Vdata, which is a display signal, the voltage signal Vdata is applied to the other terminal of the capacitor 128 connected to the signal line D1. Finally, when the signal line W1 is changed to the L level, TFT 123 is turned OFF, the node a is disconnected from the node b, and the capacitor 128 stores a voltage (Vdata-Vres).

During the time A2, display signals and the reference current are being written into the pixels in the lines other than the given line, but, since the signal lines L1, R1 and W1 are at the L level, TFT 123–TFT 126 remain in the OFF state, the capacitors 129 and 128 store the voltages Vref and Vres, respectively.

During the time C, the signal line S_pow is changed to the H level, and thereby TFT 23 is turned ON, and the reference current source 22 does not function, the lines E1 and E2 are supplied with a current directly from the power supply 26, but not from the reference current source 22. By changing the signal line L1 to the H level, TFT 127 is supplied with the current from the power supply 26 via TFT 126.

On the other hand, the signal line Dl is supplied with a triangular waveform voltage varying from the lowest voltage to the highest voltage of a range where analog voltages of display signals can take.

At the beginning of the time C, a voltage on the signal line D1 is the above-mentioned lowest voltage, a voltage at the node a is lower than the threshold voltage Vres of the inverter, and therefore TFT 122 and TFT 121 forming the inverter are turned ON and OFF, respectively. Thereupon, the current from the line E1 is supplied to the EL element 21 via TFT 126, TFT 127 and TFT 122, and the EL element 21 emits light. At this time, TFT 127 generates the constant current iref based upon the voltage Vref stored in the capacitor 129, and the current iref flows through the EL element 21, and the EL element 21 emits light uniform in intensity (the EL element is ON).

During the time C, the voltage on the signal line D1 increases gradually with time in a triangular waveform fashion, and therefore the voltage at the node a in the pixel 12 also increases. Just when the voltage on the signal line Dl becomes equal to the voltage Vdata having been written into each of the pixels 12 during the time A1, the voltage at the node a becomes just equal to the threshold voltage Vres of the inverter, and thereby TFT 122 changes from OFF to ON and TFT 121 changes from OFF to ON, the voltage at the node b changes to 0 volts, and the EL element 21 ceases to emit light (the EL elements are OFF).

The ratio in duration of the ON time to the OFF time of the EL element 21 can vary from 0% to 100% according to the voltage Vdata written into the capacitor 128 of each of the pixels 12 as a display signal. The light intensity of the EL element 21 during its ON time is kept constant by the constant current iref, and therefore the average luminance of the pixel 12 is controlled by the ratio in duration of the ON time to the OFF time of the EL element 21. Gamma correction can be made on a relationship between the analog signal voltages Vdata and the average luminance by varying the angle of slope of the triangular waveform.

As explained above, since the average luminance of each pixel can controlled to provide many gray scale levels based upon analog signal voltages Vdata which are display signals, the sixth embodiment in accordance with the present invention is capable of displaying an image containing various gray scale levels.

Further, in this embodiment, current signals to be supplied to the pixel 12 are only the constant current iref required for causing the EL element 21 to produce the maximum luminance, and consequently, it is possible to charge a capacitive load coupled to the line E1 with a high speed. A dark display by the pixel is realized by reducing the light emission time of the EL element based upon the analog signal voltage Vdata.

As is apparent from the above explanation, the sixth embodiment of the present invention is capable of providing an EL display having many gray scale levels, and a high-resolution EL display.

Advantages of the Present Invention

In the present invention, a relatively large current for causing a pixel to produce a bright image is written into a pixel as a reference current, and consequently, it makes possible rapid charging of a capacitive load formed by lines for supplying currents, the present invention is capable of realizing a high-resolution image display apparatus.

Further, since it is possible to cause a pixel to produce many gray scale levels by a time modulation circuit and a current generator circuit on the basis of the above-mentioned reference current, an image display apparatus can be realized which is capable of producing an image containing many gray scale levels.

What is claimed is:

1. An image display apparatus, comprising:

a plurality of pixels disposed on a substrate;

a plurality of signal lines for inputting display signals into said plurality of pixels; and a plurality of signal lines for inputting control signals into said plurality of pixels;

wherein said plurality of signal lines for inputting display signals into said plurality of pixels and said plurality of signal lines for inputting control signals into said plurality of pixels are arranged in a matrix configuraton;

wherein each of said plurality of pixels is provided with a light emitting element with light intensity thereof varying with a current therethrough, and a pixel circuit for driving said light emitting element;

wherein said pixel circuit is provided with current limiting means for generating a specified drive current, and a time modulator circuit for modulating a duration of time supplying said specified drive current to said light emitting element;

wherein said image display apparatus further comprises a reference-current source disposed outside of said pixel circuit for generating a reference current, said current limiting means is provided with storage means for storing information on a value of said reference current, said current limiting means is formed of at least one thin film transistor, said storage means is formed of a capacitor, and said capacitor stores a gate voltage of said at least one thin film transistor when said reference current flows through said at least one thin film transistor; and wherein said time modulator circuit is supplied with a triangular sweep voltage, and is configured to reset said gate voltage stored in said capacitor when said triangular sweep voltage becomes equal to an analog voltage signal stored in advance which is said display signal.

2. An image display apparatus according to claim 1, wherein said pixel circuit is formed of thin film transistors.

3. An image display apparatus according to claim 1, wherein said pixel circuit is formed of thin film transistors of only one of n-channel and p-channel types.

4. An image display apparatus according to claim 1, wherein said reference-current source formed of thin film transistors fabricated on said substrate.

* * * * *